US011846896B2

(12) United States Patent
Furukawa et al.

(10) Patent No.: US 11,846,896 B2
(45) Date of Patent: Dec. 19, 2023

(54) TONER CARTRIDGE INCLUDING MOVABLE SHUTTER PROVIDED WITH PROTRUSION ON WHICH ELECTRICAL CONTACT SURFACE IS PROVIDED

(71) Applicant: BROTHER KOGYO KABUSHIKI KAISHA, Nagoya (JP)

(72) Inventors: Masaaki Furukawa, Nagoya (JP); Hideshi Nishiyama, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/667,273

(22) Filed: Feb. 8, 2022

(65) Prior Publication Data

US 2022/0155706 A1 May 19, 2022

Related U.S. Application Data

(63) Continuation of application No. PCT/JP2020/036241, filed on Sep. 25, 2020.

(30) Foreign Application Priority Data

Sep. 30, 2019 (JP) ..... 2019-180985

(51) Int. Cl.
*G03G 15/08* (2006.01)
*G03G 21/18* (2006.01)

(52) U.S. Cl.
CPC ..... *G03G 15/0868* (2013.01); *G03G 15/0863* (2013.01); *G03G 21/1814* (2013.01)

(58) Field of Classification Search
CPC ..... G03G 15/0863; G03G 15/0865; G03G 15/0867; G03G 15/0868; G03G 15/0886; G03G 21/18
See application file for complete search history.

(56) References Cited

U.S. PATENT DOCUMENTS 6,205,298 B1 * 3/2001 Yamamoto ..... G03G 15/50 399/25
2008/0095554 A1 4/2008 Katogi et al.
(Continued)

FOREIGN PATENT DOCUMENTS

JP 2008-102428 A 5/2008
JP 2014-235334 A 12/2014
(Continued)

OTHER PUBLICATIONS

International Preliminary Report on Patentability and Written Opinion of the International Searching Authority issued in corresponding International Patent Application No. PCT/JP2020/036241, dated Apr. 5, 2022.
(Continued)

*Primary Examiner* — Hoang X Ngo
(74) *Attorney, Agent, or Firm* — Merchant & Gould P.C.

(57) ABSTRACT

A toner cartridge includes: a casing extending in a first direction; a toner conveying unit; a first cover; a shutter; a memory; and an electrical contact surface electrically connected to the memory. The casing includes a first toner accommodating portion having an opening. The first cover and the shutter are positioned at one end portion of the first toner accommodating portion in the first direction. The first cover has a discharge opening. The shutter has a shutter opening and a first protrusion extending in the first direction and positioned farther from the one end portion of the first toner accommodating portion than the first cover is in the first direction. When the toner cartridge is mounted to a developing device, the first protrusion is fixed in position relative to the developing device and the casing is pivotable together with the first cover relative to the developing device.

47 Claims, 13 Drawing Sheets

(56) References Cited

U.S. PATENT DOCUMENTS

| | | | | |
|---|---|---|---|---|
| 2014/0356004 | A1* | 12/2014 | Tsuritani | G03G 21/18 399/262 |
| 2017/0285529 | A1* | 10/2017 | Nishiyama | G03G 15/087 |
| 2017/0285530 | A1 | 10/2017 | Nishiyama et al. | |
| 2018/0107155 | A1 | 4/2018 | Shimizu et al. | |
| 2018/0203377 | A1 | 7/2018 | Wakamatsu | |
| 2018/0284690 | A1 | 10/2018 | Mizutani | |

FOREIGN PATENT DOCUMENTS

| | | | |
|---|---|---|---|
| JP | 2017-182008 | A | 10/2017 |
| JP | 2017-182009 | A | 10/2017 |
| JP | 2018-66973 | A | 4/2018 |
| JP | 2018-169522 | A | 11/2018 |

OTHER PUBLICATIONS

International Search Report issued in related application No. PCT/JP2020/036241, dated Nov. 17, 2020.

Office Action (Notice of Reasons for Refusal) issued in corresponding Japanese Patent Application No. 2019-180985, dated May 30, 2023.

* cited by examiner

TONER CARTRIDGE INCLUDING MOVABLE SHUTTER PROVIDED WITH PROTRUSION ON WHICH ELECTRICAL CONTACT SURFACE IS PROVIDED

CROSS REFERENCE TO RELATED APPLICATIONS

This is a by-pass continuation application of International Application No. PCT/JP2020/036241 filed on Sep. 25, 2020 which claims priority from Japanese Patent Application No. 2019-180985 filed Sep. 30, 2019. The entire contents of the earlier applications are incorporated herein by reference.

BACKGROUND

A conventional toner cartridge includes a casing, a toner conveying unit, a first cover, and a shutter. The casing is configured to accommodate toner therein. The casing has an accommodating portion opening. The toner conveying unit is configured to convey toner in the casing to the accommodating portion opening. The first cover is configured to cover the accommodating portion opening. The first cover has a discharge opening. The discharge opening allows the toner to be discharged therethrough. The shutter has a shutter opening. The shutter includes a first protrusion. The first protrusion is fixed in position relative to a developing device when the toner cartridge is mounted to the developing device. The casing is pivotable together with the first cover relative to the developing device between a first position and a second position. In a case where the casing is at the first position, the shutter closes the discharge opening. In a case where the casing is at the second position, at least a part of the shutter opening is overlapped with at least a part of the discharge opening, and the shutter opening allows the toner to be discharged through the discharge opening.

SUMMARY

There is a demand to provide a memory on the above-described conventional toner cartridge.

In view of the foregoing, it is an object of the present disclosure to provide a toner cartridge that enables an electrical contact surface electrically connected to a memory to make contact with an electrical connector of a developing device by making use of fixing a position of the toner cartridge relative to the developing device.

In order to attain the above and other object, according to one aspect, the present disclosure provides a toner cartridge including a casing, a toner conveying unit, a first cover, a shutter, a memory, and an electrical contact surface. The casing extends in a first direction and includes a first toner accommodating portion defining a first internal space therein configured to store toner. The first toner accommodating portion has one end portion in the first direction, the one end portion of the first toner accommodating portion having an accommodating portion opening configured to allow the toner in the first internal space to be discharged therefrom. The toner conveying unit extends in the first direction and is rotatable about a first axis extending in the first direction. The toner conveying unit is configured to convey the toner from the first internal space to the accommodating portion opening. The first cover is positioned at the one end portion of the first toner accommodating portion and covers the accommodating portion opening. The first cover is movable together with the casing and has a discharge opening configured to allow the toner to be discharged therethrough. The shutter is positioned at the one end portion of the first toner accommodating portion and has a shutter opening. The shutter has a first protrusion extending in the first direction and positioned farther from the one end portion of the first toner accommodating portion than the first cover is from the one end portion of the first toner accommodating portion in the first direction. The memory is configured to store information about the toner cartridge. The electrical contact surface is electrically connected to the memory and is positioned at the first protrusion. When the toner cartridge is mounted to a developing device, a position of the first protrusion is fixed relative to the developing device and the casing is pivotally movable together with the first cover between a first position and a second position relative to the developing device. The shutter closes the discharge opening in a case where the casing is at the first position. At least a part of the shutter opening is overlapped with at least a part of the discharge opening to allow the toner to be discharged through the discharge opening and through the shutter opening in a case where the casing is at the second position.

With this structure, the first protrusion is fixed in position relative to the developing device in a state where the toner cartridge is mounted on the developing device. Accordingly, the electrical contact surface of the toner cartridge can make contact with the electrical connector of the developing device by making use of fixing of the position of the first protrusion of the toner cartridge relative to the developing device, thereby realizing stable contact between the electrical contact surface of the toner cartridge and the electrical connector of the developing device.

According to another aspect, the present disclosure also provides a toner cartridge including a casing, an auger, an agitator, a first protrusion, a second protrusion, a memory, and an electrical contact surface. The casing extends in a first direction and includes: a first toner accommodating portion defining therein a first internal space extending in the first direction; and a second toner accommodating portion defining therein a second internal space extending in the first direction and in communication with the first internal space. The second toner accommodating portion is positioned at one side of the first toner accommodating portion in a second direction. The casing has a discharge opening positioned at one side of the first toner accommodating portion in the first direction. The discharge opening is configured to allow the toner in the first toner accommodating portion to be discharged therefrom. The auger is rotatable about a first axis extending in the first direction and is configured to convey the toner from the first internal space to the discharge opening. The agitator is rotatable about a second axis extending in the first direction and is configured to agitate the toner in the second internal space to convey the toner from the second internal space to the first internal space. The first protrusion is positioned at one side of the first toner accommodating portion in the first direction and at one side of the discharge opening in the first direction. The first protrusion extends in the first direction. The second protrusion is positioned at another side of the first toner accommodating portion in the first direction. The second protrusion extends in the first direction. The memory is configured to store information about the toner cartridge. The electrical contact surface is electrically connected to the memory and is positioned at the first protrusion.

With this structure, positioning of the toner cartridge relative to the developing device can be performed by the first and second protrusions upon attachment of the toner cartridge to the developing device. Accordingly, the electrical contact surface and the electrical connector of the developing device can be brought into contact with each other by making use of the positioning of the toner cartridge relative to the developing device. As a result, stable contact between the electrical contact surface of the toner cartridge and the electrical connector of the developing device can be obtained.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. Outline of Toner Cartridge 1

An outline of a toner cartridge 1 will be described with reference to FIGS. 1 through 5B.

Figure 1:
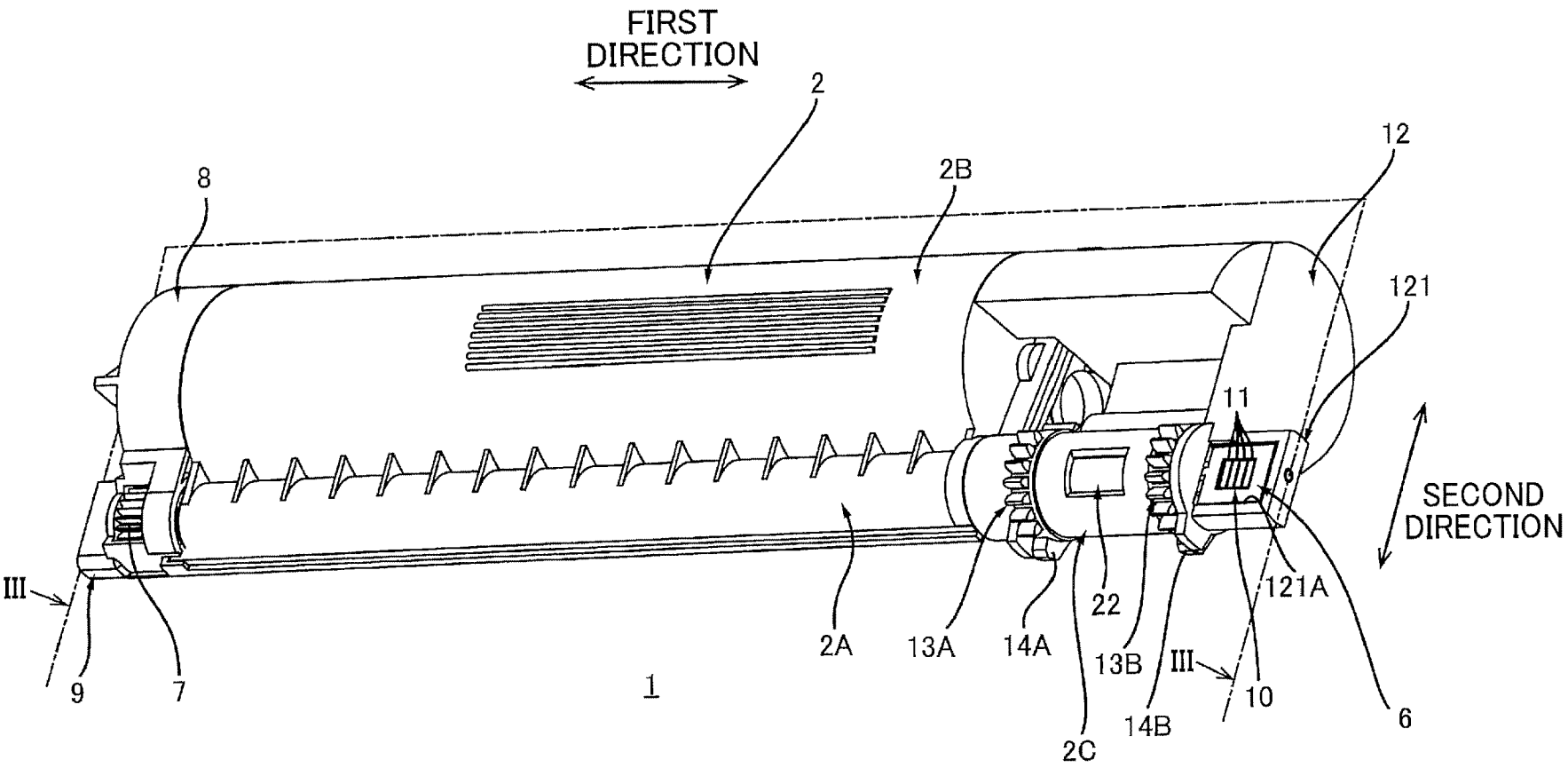
FIG. 1 is a perspective view of a toner cartridge.
Figure 2:
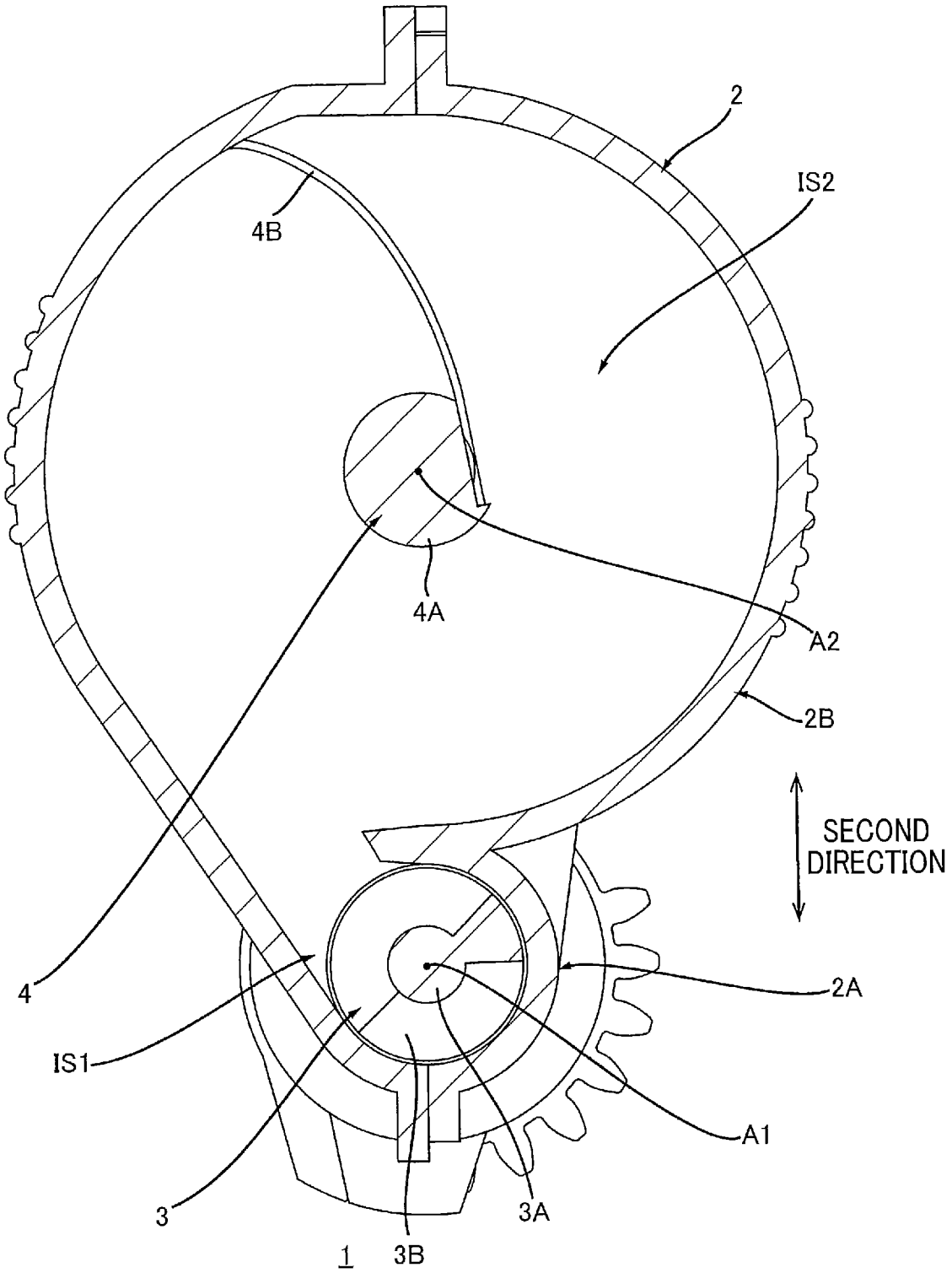
FIG. 2 is a central cross-sectional view of the toner cartridge.

As illustrated in FIGS. 1 and 2, the toner cartridge 1 includes a casing 2, a first cover 2C, an auger 3 (see FIG. 2), an agitator 4 (see FIG. 2), a shutter 5, a first protrusion 6, an auger gear 7, a gear cover 8, a second protrusion 9, a memory 10, and electrical contact surfaces 11.

1.1 Casing 2

The casing 2 extends in a first direction. The casing 2 is configured to accommodate toner therein. The casing 2 includes a first toner accommodating portion 2A and a second toner accommodating portion 2B.

1.1.1 First Toner Accommodating Portion 2A

Figure 4:
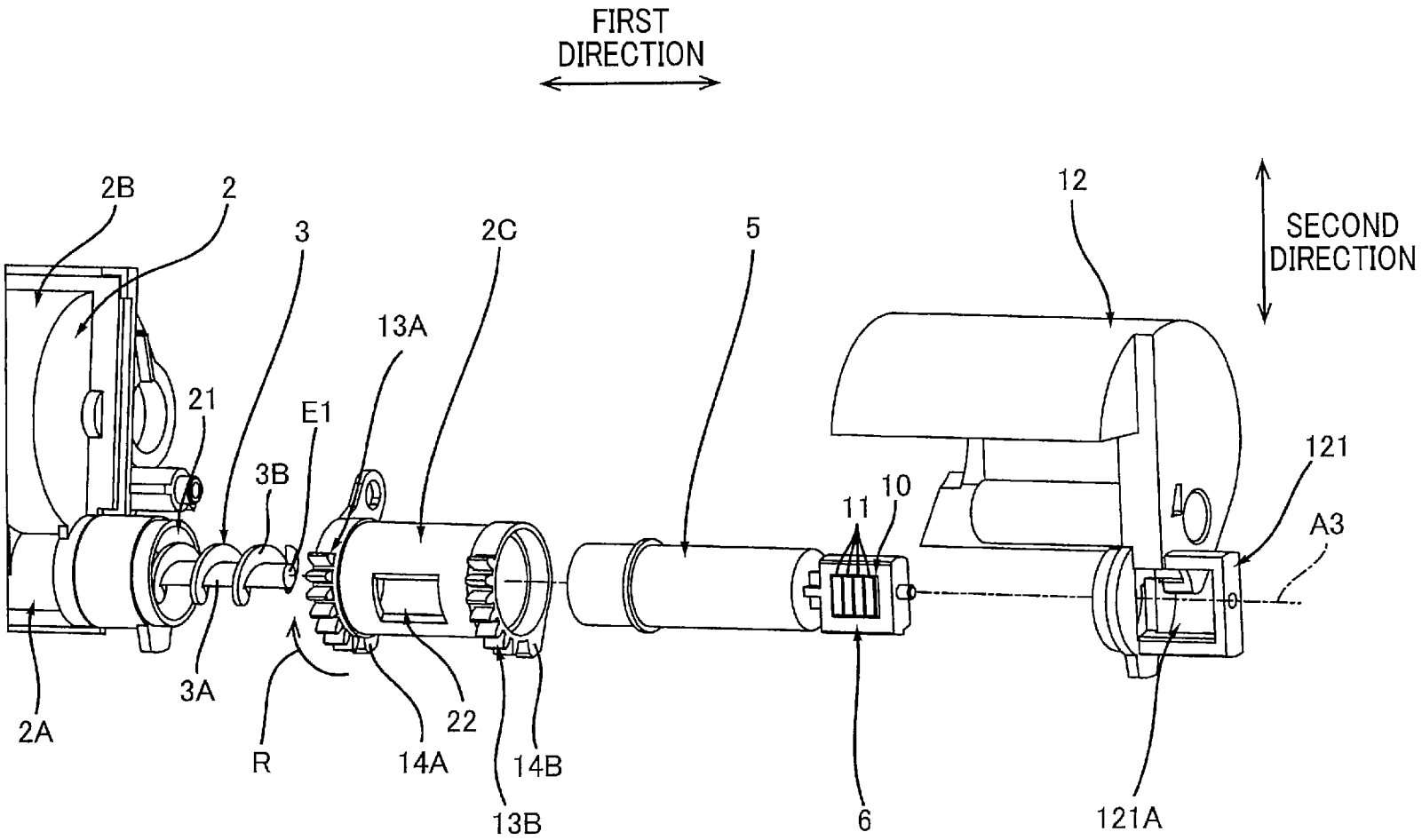
FIG. 4 is an exploded perspective view of one end portion of the toner cartridge.

The first toner accommodating portion 2A extends in the first direction. The first toner accommodating portion 2A has a hollow cylindrical shape. As illustrated in FIG. 2, the first toner accommodating portion 2A defines therein a first internal space IS1. The first internal space IS1 is configured to accommodate toner therein. As illustrated in FIG. 4, the first toner accommodating portion 2A has an accommodating portion opening 21.

The accommodating portion opening 21 is at one end portion of the first toner accommodating portion 2A in the first direction. The one end portion of the first toner accommodating portion 2A protrudes further in the first direction relative to one end portion of the second toner accommodating portion 2B in the first direction. The accommodating portion opening 21 is in communication with the first internal space IS1. The accommodating portion opening 21 allows the toner in the first internal space IS1 to be discharged through the accommodating portion opening 21.

1.1.2 Second Toner Accommodating Portion 2B

As illustrated in FIG. 1, the second toner accommodating portion 2B is positioned at one side of the first toner accommodating portion 2A in a second direction. The second direction crosses the first direction. Preferably, the second direction is perpendicular to the first direction. The second direction is defined by connecting a first axis A1 (see FIG. 2) to a second axis A2 (see FIG. 2). The first axis A1 and the second axis A2 will be described later.

The second toner accommodating portion 2B extends in the first direction. The second toner accommodating portion 2B has a hollow cylindrical shape. The second toner accommodating portion 2B has an outer diameter greater than an outer diameter of the first toner accommodating portion 2A.

As illustrated in FIG. 2, the second toner accommodating portion 2B defines a second internal space IS2 therein. The second internal space IS2 is configured to accommodate toner therein. The first internal space IS1 and the second internal space IS2 are juxtaposed with each other in the second direction. The second internal space IS2 has an inner diameter greater than an inner diameter of the first internal space IS1. The second internal space IS2 has an internal volume greater than an internal volume of the first internal space IS1. The second internal space IS2 is connected to the first internal space IS1.

Figure 3:
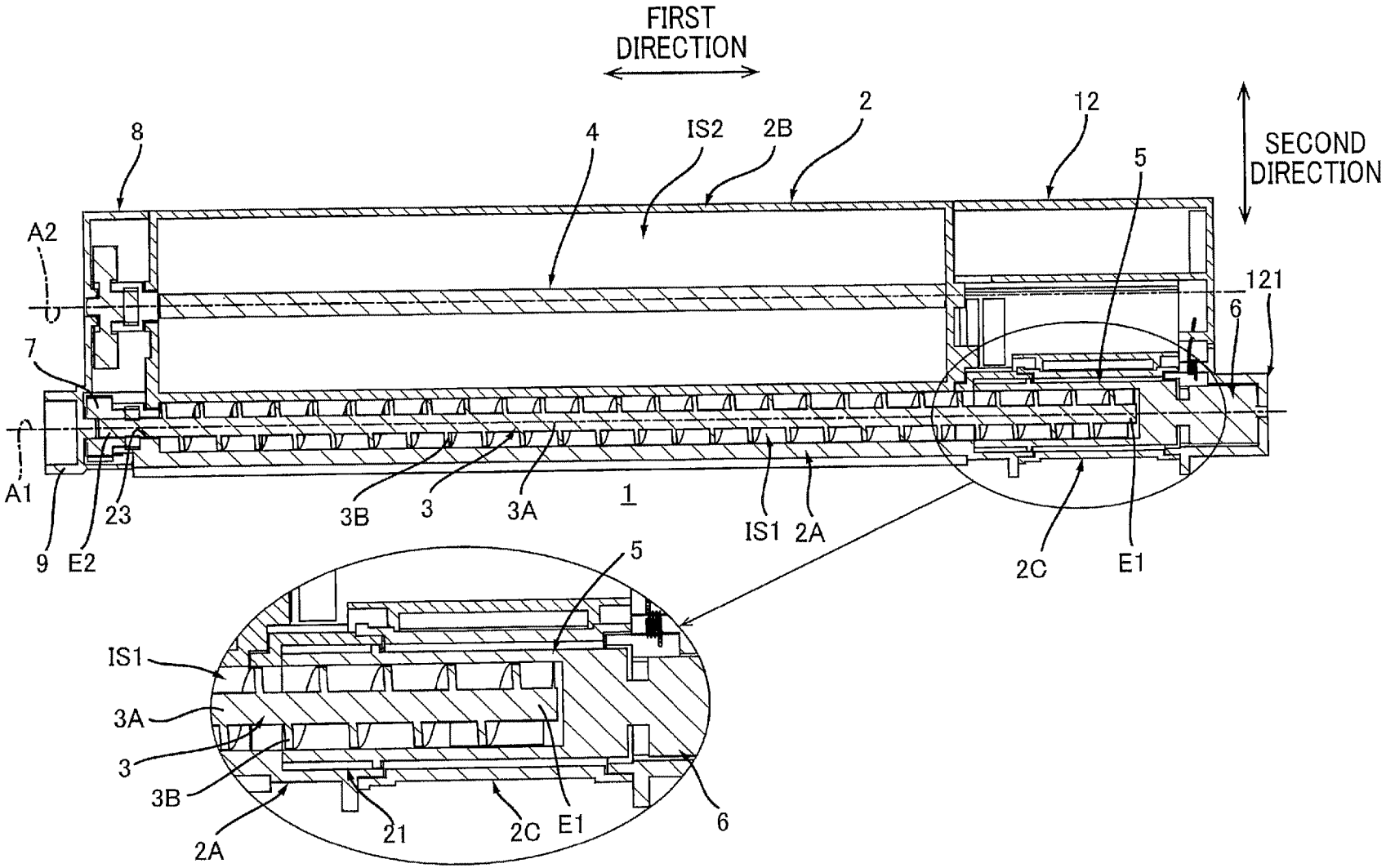
FIG. 3 is a cross-sectional view taken along a plane in FIG. 1.

As illustrated in FIG. 3, the second internal space IS2 has a length in the first direction shorter than a length in the first direction of the first internal space IS1.

Incidentally, the first toner accommodating portion 2A and the second toner accommodating portion 2B may be integral with each other. Alternatively, the first toner accommodating portion 2A and the second toner accommodating portion 2B may be provided as separate members and may be assembled to each other.

1.2 First Cover 2C

As illustrated in FIGS. 3 and 4, the first cover 2C is positioned at the one end portion of the first toner accommodating portion 2A. Specifically, the first cover 2C is attached to the one end portion of the first toner accommodating portion 2A. Hence, the first cover 2C is movable together with the casing 2.

The first cover 2C covers the accommodating portion opening 21. Further, the first cover 2C covers at least a part of one end portion E1 of the auger 3 in the first direction. Specifically, the first cover 2C covers a peripheral surface of the one end portion E1 of the auger 3. The first cover 2C extends along the peripheral surface of the one end portion E1 of the auger 3. Specifically, the first cover 2C has a hollow cylindrical shape. The first cover 2C extends in the first direction. As illustrated in FIG. 1, the first cover 2C has a discharge opening 22.

Incidentally, a combination of the casing 2 and the first cover 2C may be regarded as a casing of the toner cartridge 1. In other words, the casing 2 may include the first cover 2C, and, hence, may have the discharge opening 22.

The discharge opening 22 is positioned at one side of the first toner accommodating portion 2A in the first direction. The discharge opening 22 is positioned apart from the first toner accommodating portion 2A in the first direction. The discharge opening 22 is positioned apart from the accommodating portion opening 21 (see FIG. 4) in the first direction. The discharge opening 22 allows toner to be discharged therethrough. The discharge opening 22 allows the toner in the first internal space IS1 to be discharged through the discharge opening 22.

1.3 Auger 3

Figure 5A:
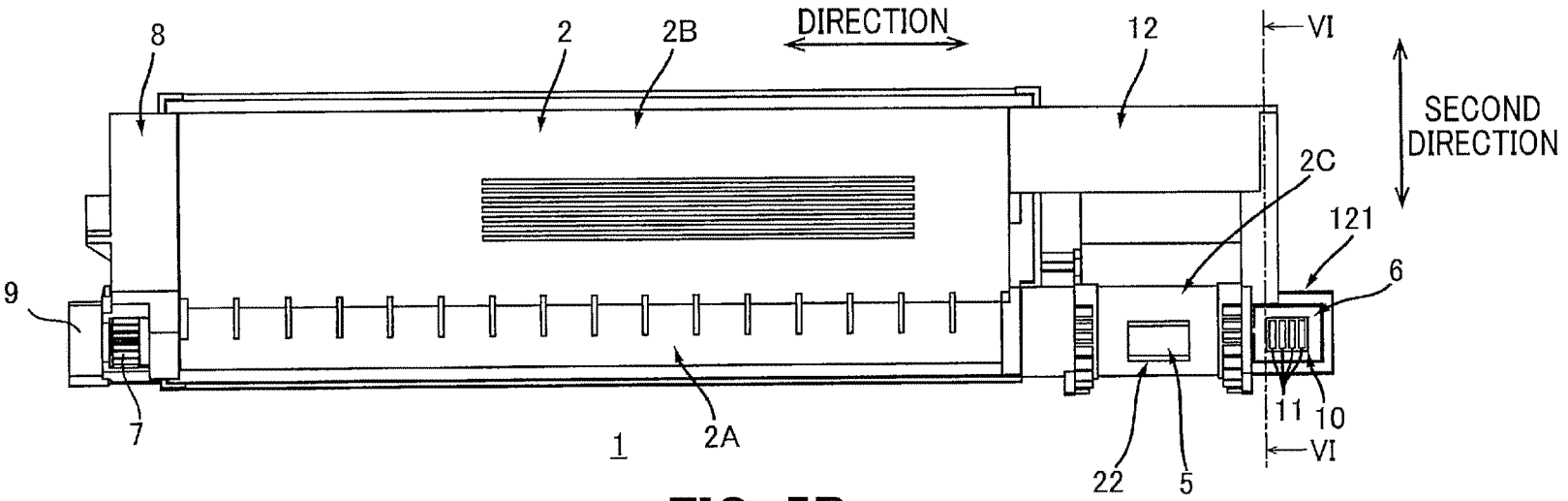
FIG. 5A is a side view of the toner cartridge as viewed in a direction crossing a second direction and particularly illustrating a state where a shutter is at its closed position.
Figure 5B:
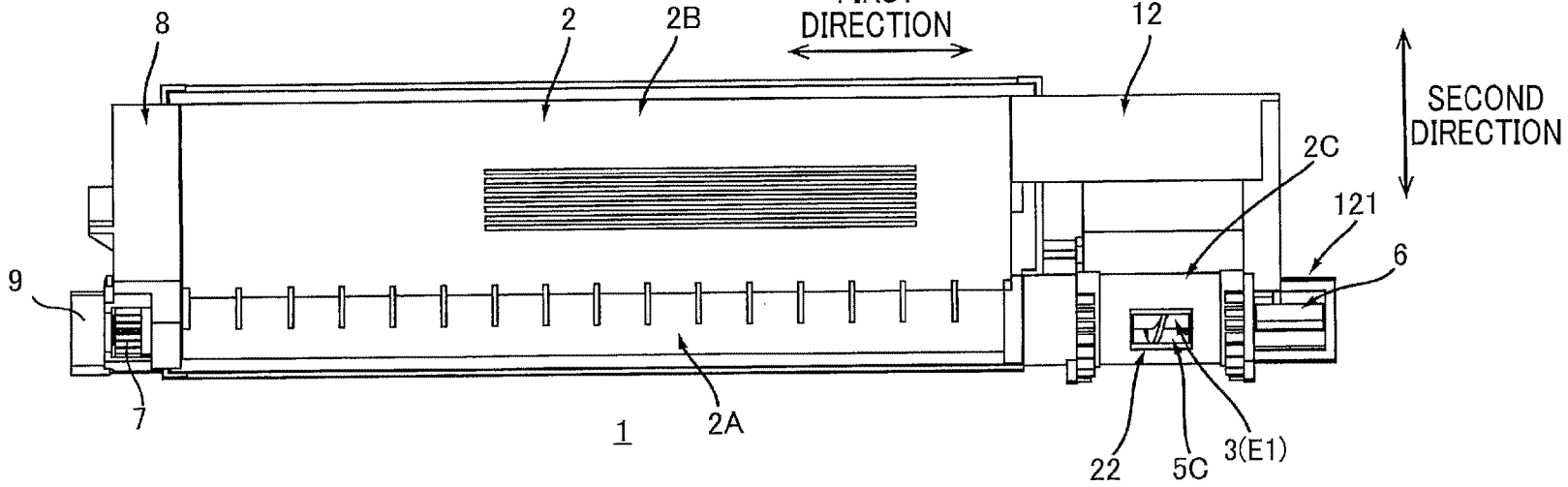
FIG. 5B is a side view of the toner cartridge as viewed in the direction crossing the second direction and particularly illustrating a state where the shutter is at its open position.

As illustrated in FIG. 3, the auger 3 is configured to convey the toner in the first internal space IS1 to the discharge opening 22 (see FIG. 5). The auger 3 has a part positioned inside the first internal space IS1. The auger 3 extends in the first direction. The auger 3 has the one end portion E1 and another end portion E2 spaced away from the one end portion E1 in the first direction. The auger 3 is rotatable about the first axis A1 extending in the first direction. As illustrated in FIG. 4, the auger 3 extends through the accommodating portion opening 21. The one end portion E1 of the auger 3 is exposed to an outside of the first toner accommodating portion 2A through the accommodating portion opening 21. The one end portion E1 of the auger 3 protrudes out from the accommodating portion opening 21 in the first direction. The auger 3 is configured to convey the toner from the first internal space IS1 to the accommodating portion opening 21. The auger 3 extends to the discharge opening 22 (see FIG. 5B) in the first direction. Hence, the auger 3 can convey the toner from the first internal space IS1 to the discharge opening 22. The peripheral surface of the one end portion E1 of the auger 3 has a part exposed to the outside through the discharge opening 22.

Specifically, as illustrated in FIG. 3, the auger 3 includes a shaft 3A and a helical portion 3B. The shaft 3A extends along the first axis A1. The helical portion 3B protrudes outward from the shaft 3A in a radial direction of the first toner accommodating portion 2A. The helical portion 3B has a helical shape extending in the first direction. In other words, the auger 3 has a helical shape.

1.4 Agitator 4

As illustrated in FIGS. 2 and 3, the agitator 4 is positioned in the second internal space IS2. The agitator 4 is rotatable about the second axis A2 extending in the first direction. The agitator 4 is configured to rotate to agitate the toner in the second internal space IS2 and to convey the toner from the second internal space IS2 to the first internal space IS1. The agitator 4 includes an agitator shaft 4A and a fin 4B.

The agitator shaft 4A extends along the second axis A2. The agitator shaft 4A has a solid cylindrical shape.

The fin 4B is positioned in the second internal space IS2. The fin 4B is attached to the agitator shaft 4A. The fin 4B extends in a radial direction of the agitator shaft 4A. The fin 4B is rotatable together with the agitator shaft 4A. The discharge opening 22 is positioned outward of the fin 4B toward the one side in the first direction.

1.5 Shutter 5

As illustrated in FIGS. 3 and 4, the shutter 5 is positioned at the one end portion of the first toner accommodating portion 2A in the first direction. The shutter 5 is attached to the one end portion of the first toner accommodating portion 2A. The shutter 5 is inserted in the first cover 2C and the one end portion of the first toner accommodating portion 2A. The shutter 5 is inserted in the accommodating portion opening 21. With the shutter 5 inserted in the accommodating portion opening 21, an internal space of the shutter 5 is in communication with the first internal space IS1. Hence, the toner in the first internal space IS1 can flow into the internal space of the shutter 5. The shutter 5 is rotatable relative to the casing 2 and the first cover 2C between a closed position (see FIG. 5A) and an open position (see FIG. 5B). The shutter 5 is rotatable between the closed position and the open position about a third axis A3. The third axis A3 extends in the first direction.

Specifically, the shutter 5 extends in the first direction. The shutter 5 has a hollow cylindrical shape. The shutter 5 covers the peripheral surface of the one end portion E1 of the auger 3. The shutter 5 extends along the peripheral surface of the one end portion E1 of the auger 3. Further, the shutter 5 extends along an inner peripheral surface of the first cover 2C. In other words, the first cover 2C extends along an outer peripheral surface of the shutter 5 to cover the outer peripheral surface of the shutter 5. The shutter 5 has a shutter opening 5C (see FIG. 5B).

With the shutter 5 inserted in the accommodating portion opening 21, the shutter opening 5C is positioned apart from the accommodating portion opening 21 in the first direction. The shutter opening 5C is in communication with the internal space of the shutter 5. The shutter opening 5C allows the toner in the shutter 5 to be discharged through the shutter opening 5C.

As illustrated in FIG. 5A, the shutter 5 closes the discharge opening 22 when the shutter 5 is at the closed position. Specifically, the shutter opening 5C is positioned apart from the discharge opening 22 in a rotational direction of the shutter 5 when the shutter 5 is at the closed position. Hence, the shutter opening 5C is not in communication with the discharge opening 22, and the toner inside the shutter 5 cannot be discharged through the discharge opening 22.

On the other hand, as illustrated in FIG. 5B, the discharge opening 22 is opened in a state where the shutter 5 is at the open position. At least a part of the shutter opening 5C is overlapped with at least a part of the discharge opening 22 when the shutter is at the open position. Hence, the shutter opening 5C allows the toner in the internal space of the shutter 5 to be discharged therefrom through the discharge opening 22.

Incidentally, the one end portion E1 of the auger 3 is exposed to the outside through the discharge opening 22 when the shutter 5 is at the open position.

1.6 First Protrusion 6

As illustrated in FIG. 4, the first protrusion 6 is positioned at the one side of the first toner accommodating portion 2A in the first direction, and at the one side of the discharge opening 22 in the first direction. The first protrusion 6 is positioned farther from the one end portion of the first toner accommodating portion 2A than the first cover 2C is from the one end portion of the first toner accommodating portion 2A in the first direction. The first protrusion 6 is positioned opposite to the first toner accommodating portion 2A with respect to the first cover 2C in the first direction. The first protrusion 6 is fixed in position relative to a developing device 31 (see FIG. 7) described later when the toner cartridge 1 is mounted to the developing device 31. The first protrusion 6 extends in the first direction. The first protrusion 6 extends from one end portion of the shutter 5. In other words, the shutter 5 has the first protrusion 6. Specifically, the first protrusion 6 extends from the shutter 5. The first protrusion 6 is rotatable together with the shutter 5 relative to the casing 2. The first protrusion 6 has a base end portion and a tip end portion in the first direction. The base end portion is connected to the shutter 5. The tip end portion is positioned opposite to the shutter 5 with respect to the base end portion in the first direction.

1.7 Auger Gear 7

As illustrated in FIG. 1, the auger gear 7 is positioned at another end portion of the casing 2 in the first direction. The auger gear 7 is positioned at an outer surface of the first toner accommodating portion 2A. As illustrated in FIG. 3, the auger gear 7 is attached to the other end portion E2 of the auger 3 in the first direction. Specifically, the first toner accommodating portion 2A has a first through-hole 23. The first through-hole 23 is positioned in another end portion of the first toner accommodating portion 2A in the first direction. The first through-hole 23 penetrates through the other end portion of the first toner accommodating portion 2A in the first direction. The other end portion E2 of the auger 3 in the first direction is inserted in the first through-hole 23. The other end portion E2 of the auger 3 in the first direction protrudes out of the first toner accommodating portion 2A, through the first through-hole 23, toward another side in the first direction. The auger gear 7 is attached to the other end portion E2 of the auger 3 in the first direction at the other end side of the first toner accommodating portion 2A in the first direction. The auger gear 7 is rotatable together with the auger 3.

1.8 Gear Cover 8

As illustrated in FIG. 1, the gear cover 8 is attached to the other end portion of the casing 2 in the first direction. The gear cover 8 covers the auger gear 7.

1.9 Second Protrusion 9

The second protrusion 9 is positioned at the other side of the first toner accommodating portion 2A. In other words, the second protrusion 9 is positioned opposite to the discharge opening 22 and the first protrusion 6 with respect to the first toner accommodating portion 2A in the first direction. The second protrusion 9 is positioned at the other side of the auger gear 7 in the first direction. In other words, the second protrusion 9 is positioned opposite to the discharge opening 22 and the first protrusion 6 with respect to the auger gear 7 in the first direction. The second protrusion 9 is positioned farther from the discharge opening 22 and the first protrusion 6 than the auger gear 7 is from the discharge opening 22 and the first protrusion 6 in the first direction.

The second protrusion 9 is positioned at the other side of the gear cover 8 in the first direction. In other words, the second protrusion 9 is positioned opposite to the discharge opening 22 and the first protrusion 6 with respect to the gear cover 8 in the first direction. The second protrusion 9 extends from the gear cover 8. The second protrusion 9 may be attached to the gear cover 8. The second protrusion 9 extends in the first direction and the second direction. The second protrusion 9 has a width in the third direction (crossing the first direction and the second direction) different from the width of the first protrusion 6 in the third direction. The width in the third direction of the second protrusion 9 is greater than the width in the third direction of the first protrusion 6.

1.10 Memory 10

As illustrated in FIG. 1, the memory 10 is positioned on an outer surface of the first protrusion 6. The memory 10 is attached to the outer surface of the first protrusion 6. The memory 10 is rotatable together with the shutter 5 and the first protrusion 6 relative to the casing 2. The memory 10 is an IC chip. The memory 10 has a flat plate-like shape. The memory 10 is configured to store information about the toner cartridge 1. The information about the toner cartridge 1 may be, for example, information as to whether the toner cartridge 1 is a new cartridge or a used cartridge, and information as to the number of sheets (or the number of dot counts) on which printing can be performed.

1.11 Electrical Contact Surfaces 11

A plurality of electrical contact surfaces 11 is positioned at the outer surface of the first protrusion 6. The plurality of electrical contact surfaces 11 is rotatable together with the shutter 5 and the first protrusion 6 relative to the casing 2. Specifically, the plurality of electrical contact surfaces 11 is positioned on a surface of the memory 10. In other words, according to the present embodiment, the memory 10 has the electrical contact surfaces 11. The plurality of electrical contact surfaces 11 is electrically connected to the memory 10. Incidentally, the plurality of electrical contact surfaces 11 may be positioned away from the memory 10. In the latter case, each of the electrical contact surfaces 11 is electrically connected to the memory 10 through a wiring. A single electrical contact surface 11 may also be available, alternatively.

2. Details of Toner Cartridge 1

The toner cartridge 1 will be described in detail with reference to FIGS. 1 and 6.

The toner cartridge 1 further includes a second cover 12, gear portions 13A, 13B, and protrusions 14A, 14B.

2.1 Second Cover 12

As illustrated in FIG. 1, the second cover 12 is attached to the second toner accommodating portion 2B. The second cover 12 is movable together with the casing 2 relative to the shutter 5. The second cover 12 extends in the first direction. The second cover 12 has one end portion and another end portion in the first direction. The one end portion is positioned farther from the casing 2 than the other end portion is from the casing 2 in the first direction. The second cover 12 includes a cover portion 121, a locking member 122 (see FIG. 6), a spring 123 (see FIG. 6), and a stopper 124.

2.1.1 Cover Portion 121

The cover portion 121 is positioned at the one end portion of the second cover 12. The cover portion 121 protrudes outward from the one end portion of the second cover 12 in the first direction. The cover portion 121 extends in the second direction. The cover portion 121 surrounds the first protrusion 6. The cover portion 121 covers at least a part of the tip end portion of the first protrusion 6 in the first direction. That is, the second cover 12 covers at least the part of the tip end portion of the first protrusion 6.

The cover portion 121 rotatably supports the tip end portion of the first protrusion 6. In other words, the second cover 12 rotatably supports the tip end portion of the first protrusion 6. The cover portion 121 has an opening 121A. The first protrusion 6 is positioned in the opening 121A. The memory 10 is positioned in the opening 121A. The plurality of electrical contact surfaces 11 is positioned in the opening 121A. At least a part of the first protrusion 6 is exposed to an outside through the opening 121A. The outer surface of the first protrusion 6 is exposed to the outside through the opening 121A. The opening 121A allows the memory 10 to be exposed to the outside. The opening 121A allows the plurality of electrical contact surfaces 11 to be exposed to the outside.

2.1.2 Locking Member 122

Figure 6:
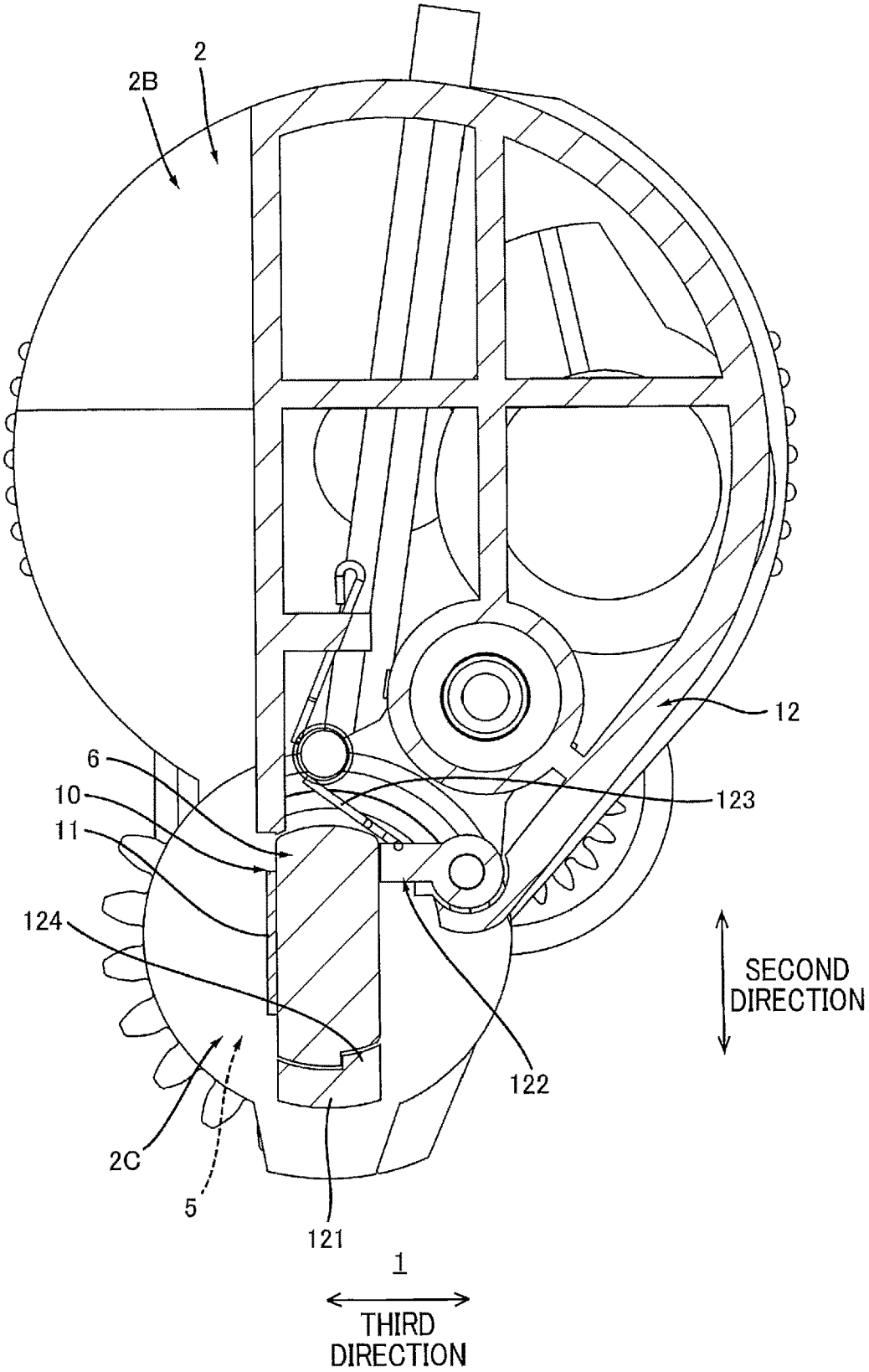
FIG. 6 is a cross-sectional view of the toner cartridge taken along a line VI-VI in FIG. 5A.
Figure 11:
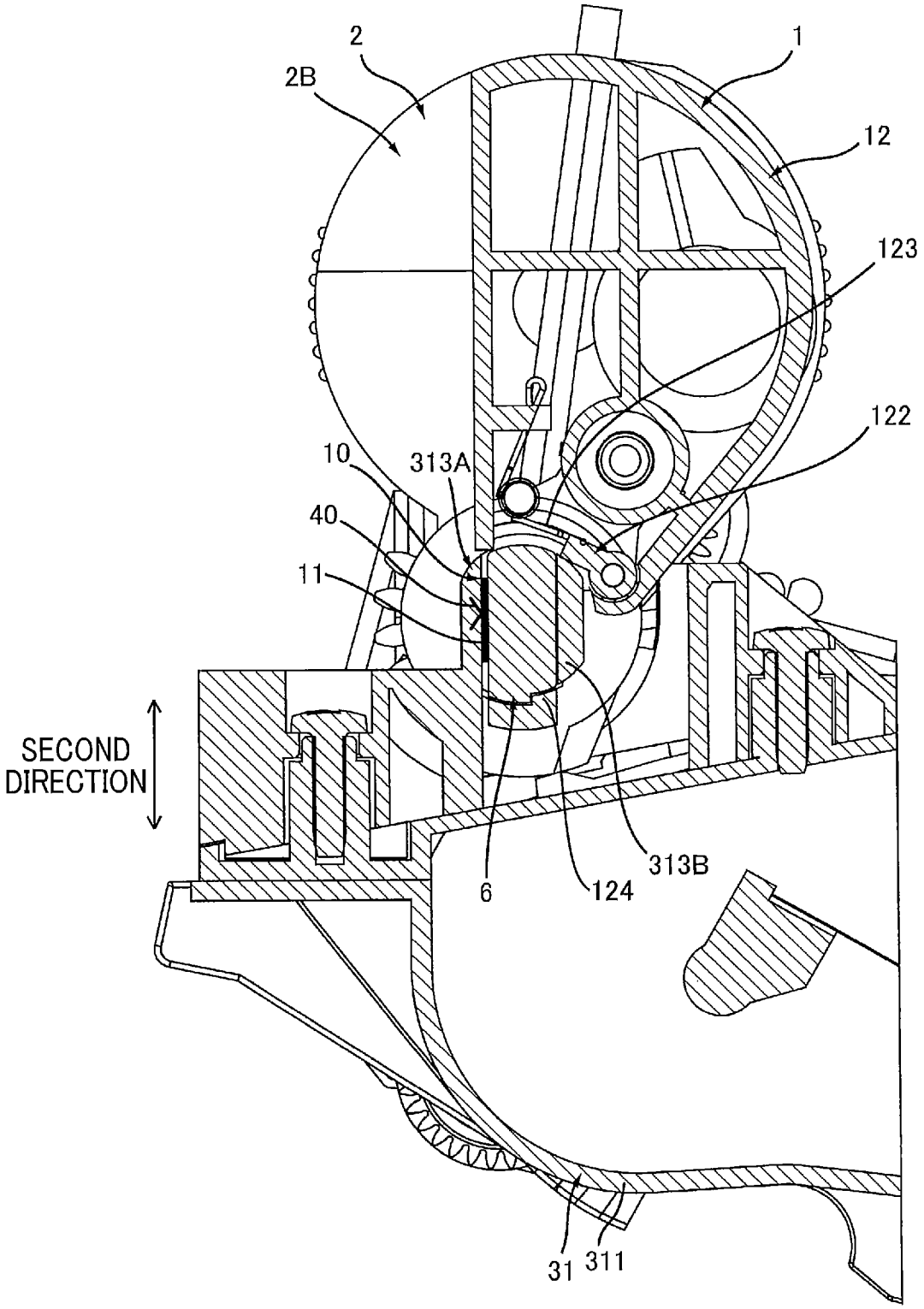
FIG. 11 is a cross-sectional view of the developing device and the toner cartridge taken along a plane passing through a locking member, and particularly illustrating a state where the locking member is at its unlocking position.

The locking member 122 illustrated in FIG. 6 is movable between a locking position (see FIG. 6) and an unlocking position (see FIG. 11). Specifically, the locking member 122 is pivotally movable between the locking position and the unlocking position. The locking member 122 is pivotally movably supported by the second cover 12.

The locking member 122 is configured to contact the first protrusion 6 when the locking member 122 is at the locking position. Hence, the locking member 122 locks the first protrusion 6 to the second cover 12 when the locking member 122 is at the locking position. Here, "locking the first protrusion 6 to the second cover 12" means "restricting the first protrusion 6 from rotating relative to the second cover 12". In a state where the toner cartridge 1 is detached from the developing device 31 described later, the locking member 122 locks the first protrusion 6 to the second cover 12 to restrict the shutter 5 from moving to the open position from the closed position.

On the other hand, as illustrated in FIG. 11, the locking member 122 is separated away from the first protrusion 6 when the locking member 122 is at the unlocking position. Hence, the locking member 122 releases the locking of the first protrusion 6 to the second cover 12 when the locking member 122 is at the unlocking position.

2.1.3 Spring 123

As illustrated in FIG. 6, the spring 123 urges the locking member 122 toward the locking position. The spring 123 is a torsion spring.

2.1.4 Stopper 124

The stopper 124 is positioned at an inner surface of the cover portion 121. The stopper 124 protrudes from the inner surface of the cover portion 121. The first protrusion 6 is configured to contact the stopper 124 in a case where the first protrusion 6 is urged to rotate in a direction opposite to a rotational direction of the first protrusion 6 from the closed position to the open position (reverse rotational direction). Hence, the stopper 124 stops the first protrusion 6 from rotating in the reverse rotational direction in the case where the shutter 5 is at the closed position.

2.2 Gear Portions 13A, 13B and Protrusions 14A, 14B

The gear portions 13A, 13B and the protrusions 14A, 14B illustrated in FIG. 1 are configured to move a developing shutter 311D (see FIGS. 12A and 12B, described later) of the developing device 31.

2.2.1 Gear Portions 13A, 13B

Referring to FIG. 4, the gear portion 13A is positioned at a peripheral surface of the first cover 2C. In other words, the first cover 2C has the gear portion 13A. The gear portion 13A includes a plurality of gear teeth. That is, the first cover 2C has the plurality of gear teeth. The plurality of gear teeth of the gear portion 13A is positioned on the peripheral surface of the first cover 2C to extend in a rotational direction thereof relative to the shutter 5. The plurality of gear teeth of the gear portion 13A is arranged in line in the rotational direction of the first cover 2C relative to the shutter 5. The plurality of gear teeth of the gear portion 13A is arranged in line in a rotational direction of the auger 3.

The gear portion 13B is positioned apart from the gear portion 13A in the first direction. The discharge opening 22 is positioned between the gear portion 13A and 13B. The description as to the gear portion 13A is also applicable to the gear portion 13B.

2.2.2 Protrusions 14A, 14B

The protrusion 14A is positioned at the peripheral surface of the first cover 2C. In other words, the first cover 2C has the protrusion 14A. The protrusion 14A protrudes from the peripheral surface of the first cover 2C. The protrusion 14A is arranged in line with the plurality of gear teeth of the gear portion 13A in the rotational direction of the first cover 2C relative to the shutter 5. Specifically, the protrusion 14A is positioned upstream of the plurality of gear teeth of the gear portion 13A in a rotational direction R (see FIG. 4) of the first cover 2C from a second position (illustrated in FIGS. 8B and 9B) to a first position (illustrated in FIGS. 8A and 9A). The protrusion 14A is arranged in line with the plurality of gear teeth of the gear portion 13A in the rotational direction R of the first cover 2C at an interval greater than an interval between the neighboring gear teeth.

The protrusion 14B is positioned apart from the protrusion 14A in the first direction. The description as to the protrusion 14A is also applicable to the protrusion 14B.

3. Developing Device 31

Figure 7:
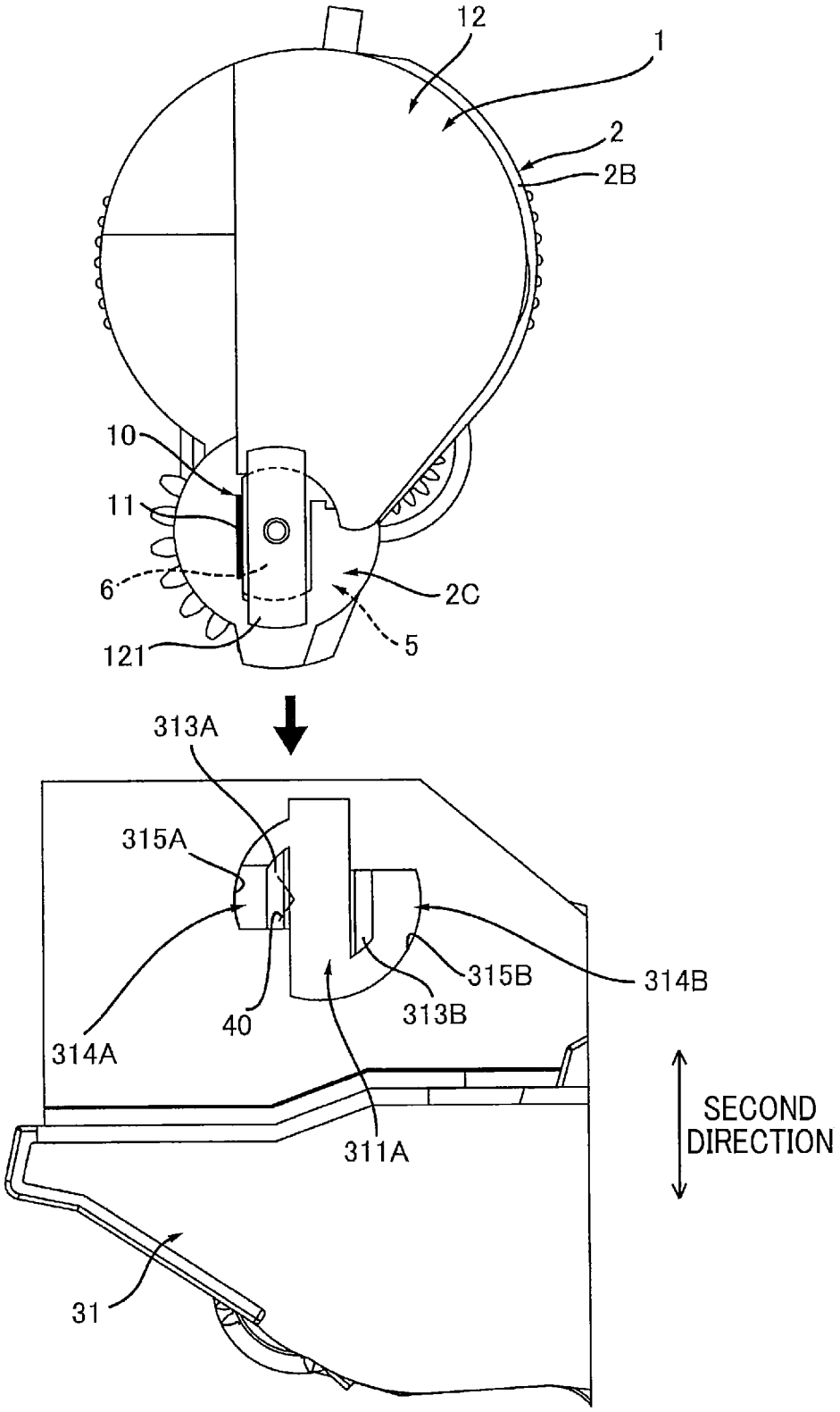
FIG. 7 is a view for description of mounting of the toner cartridge on a developing device, and particularly illustrating a state prior to mounting of the toner cartridge on the developing device.

As illustrated in FIG. 7, the toner cartridge 1 is configured to be mounted on the developing device 31. As illustrated in FIGS. 8A through 9B, attachment of the toner cartridge 1 to the developing device 31 is completed by pivotally moving the casing 2 about axes of the first protrusion 6 (see FIGS. 8A and 8B) and the second protrusion 9 (see FIGS. 9A and 9B) from the first position (illustrated in FIGS. 8A and 9A) to the second position (illustrated in FIGS. 8B and 9B) after the toner cartridge 1 is mounted to the developing device 31. The casing 2 is pivotally movable together with the first cover 2C and the second cover 12 between the first position and the second position relative to the developing device 31.

Here, "pivotal movement of the casing 2" means "pivotal movement of the casing 2 and the gear cover 8 about the first axis A1". The state where the toner cartridge 1 is mounted on the developing device 31 means a state prior to pivotal movement of the toner cartridge 1, i.e., a state where the casing 2 is at the first position. The state where the toner cartridge 1 is attached to the developing device 31 means a state after pivotal movement of the toner cartridge 1, i.e., a state where the casing 2 is at the second position.

Next, the developing device 31 will be described in detail.

The developing device 31 is configured to develop images by using the toner supplied from the toner cartridge 1. According to the present embodiment, the developing device 31 is of a cartridge type which is attachable to and detachable from an image-forming apparatus.

Figure 10:
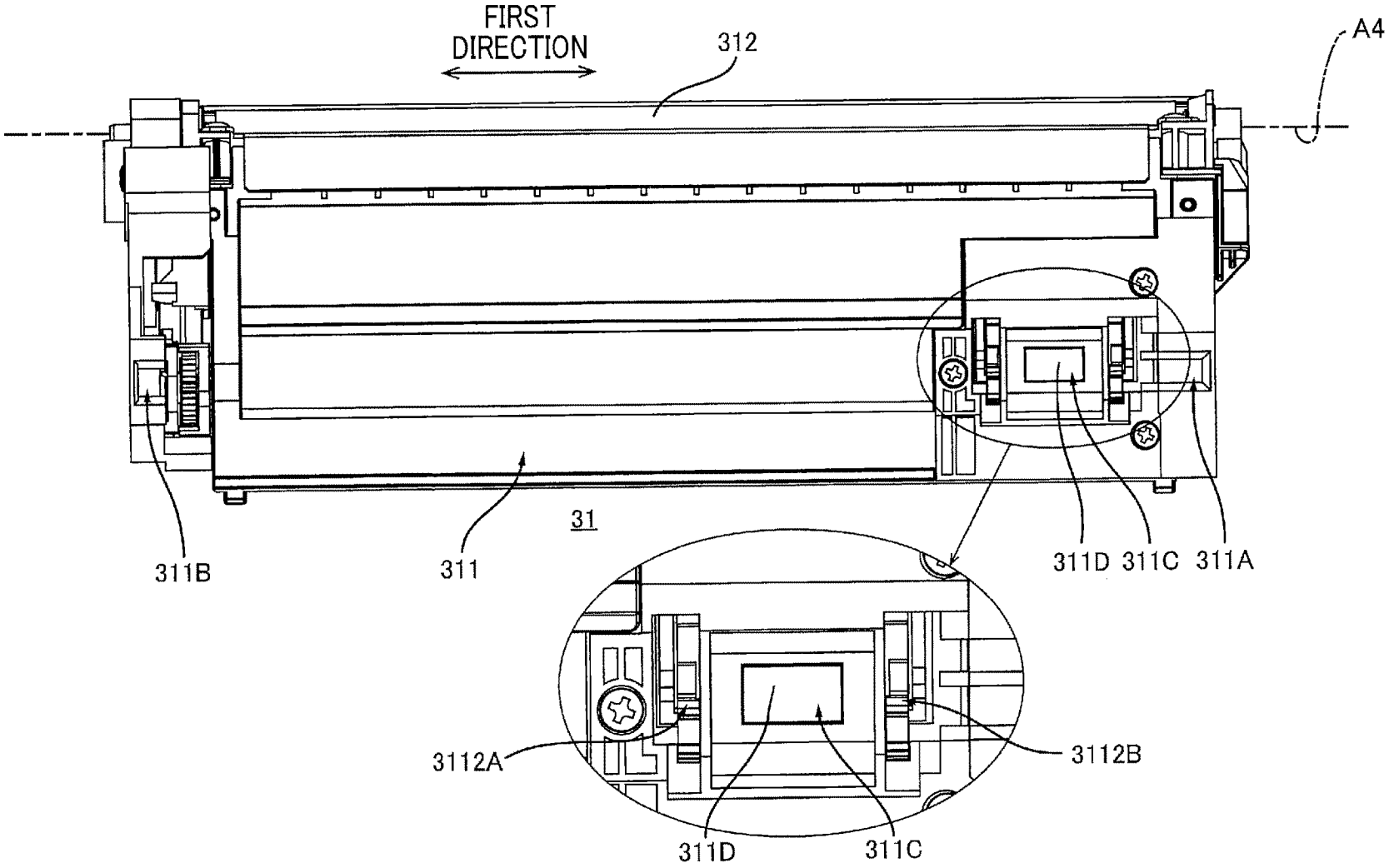
FIG. 10 is a plan view of the developing device as viewed in a mounting direction of the toner cartridge on the developing device.

As illustrated in FIG. 10, the developing device 31 includes a developing casing 311 and a developing roller 312. Incidentally, the developing device 31 may further include a photosensitive body.

3.1 Developing Casing 311

The developing casing 311 is configured to accommodate toner supplied from the toner cartridge 1. As illustrated in FIG. 10, the developing casing 311 has a groove 311A, a groove 311B, and a developing opening 311C. The developing casing 311 includes the developing shutter 311D.

3.1.1 Groove 311A

The groove 311A is positioned at one end portion of the developing casing 311 in the first direction. As illustrated in FIG. 8A, the first protrusion 6 is fitted in the groove 311A when the toner cartridge 1 is mounted on the developing device 31. The position of the first protrusion 6 relative to the developing device 31 is thus fixed when the toner cartridge 1 is mounted on the developing device 31.

Specifically, as illustrated in FIG. 7, the groove 311A includes a protrusion 313A, a protrusion 313B, a recessed portion 314A, and a recessed portion 314B.

3.1.1.1 Protrusions 313A and 313B

The protrusion 313A extends in the second direction. The protrusion 313A has an electrical connector 40. That is, the developing device 31 includes the electrical connector 40.

The protrusion 313B is positioned apart from the protrusion 313A in a widthwise direction of the groove 311A. The protrusion 313B extends in the second direction.

As illustrated in FIGS. 8A and 11, the first protrusion 6 is positioned between the protrusion 313A and the protrusion 313B when the toner cartridge 1 is mounted on the developing device 31. The protrusion 313A and the protrusion 313B are respectively in contact with surfaces of the first protrusion 6 exposed through the opening 121A when the toner cartridge 1 is mounted to the developing device 31. In this way, the protrusion 313A and the protrusion 313B restrict the first protrusion 6 from rotating when the toner cartridge 1 is mounted to the developing device 31, thereby fixing the position of the shutter 5 relative to the developing device 31. The position of the surface of the first protrusion 6 exposed through the opening 121A is fixed relative to the developing device 31 when the toner cartridge 1 is mounted on the developing device 31.

As such, the memory 10 and the plurality of electrical contact surfaces 11 exposed through the opening 121A are fixed in position relative to the developing device 31 when the toner cartridge 1 is mounted on the developing device 31. When the toner cartridge 1 is mounted to the developing device 31, the electrical connector 40 of the protrusion 313A is in contact with the electrical contact surfaces 11 of the toner cartridge 1 in a state where the positions of the memory 10 and the plurality of electrical contact surfaces 11 are fixed relative to the developing device 31. In other words, the memory 10 and the plurality of electrical contact surfaces 11 are fixed in position relative to the developing device 31 by making use of the positioning of the toner cartridge 1 relative to the developing device 31, to realize contact of the electrical contact surfaces 11 of the toner cartridge 1 with the electrical connector 40 of the developing device 31. Accordingly, stabilized contact between the plurality of electrical contact surfaces 11 and the electrical connector 40 can be obtained in the state where the toner cartridge 1 is mounted to the developing device 31.

On the other hand, the protrusion 313A and the protrusion 313B do not contact the cover portion 121 (see FIG. 1) when the toner cartridge 1 is mounted to the developing device 31.

Further, as illustrated in FIG. 11, the locking member 122 comes in contact with the protrusion 313B (which is a part of the developing device 31) when the toner cartridge 1 is mounted to the developing device 31, thereby moving the locking member 122 from the locking position to the unlocking position. The locking member 122 thus releases the locking of the first protrusion 6 when the toner cartridge 1 is mounted to the developing device 31. Hence, the cover portion 121 becomes rotatable relative to the shutter 5 whose position is fixed relative to the developing device 31 when the toner cartridge 1 is mounted to the developing device 31.

At this time, in the case where the casing 2 is at the first position, the first protrusion 6 comes into contact with the stopper 124 when the first protrusion 6 is urged to rotate in a direction opposite to a rotational direction (pivotally moving direction) of the casing 2 from the first position to the second position relative to the shutter 5, i.e., in the reverse rotational direction. Thus, the stopper 124 restricts the rotation of the first protrusion 6 in the reverse rotational direction in the case where the casing 2 is at the first position.

Figure 8B:
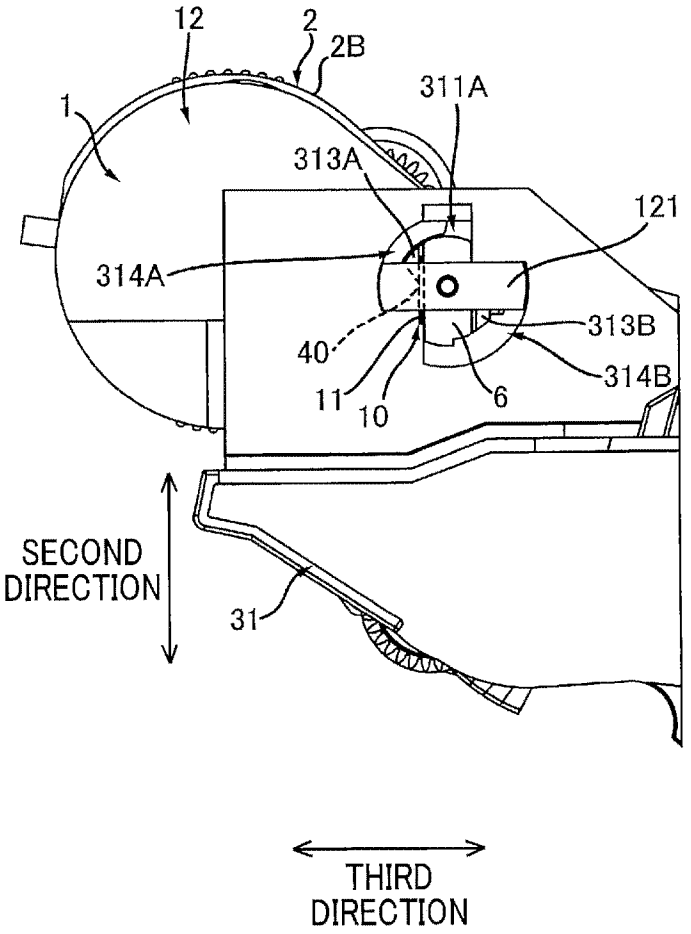
FIG. 8B is a side view illustrating a state where the casing illustrated in FIG. 8A is at its second position and the toner cartridge is attached to the developing device.
Figure 8A:
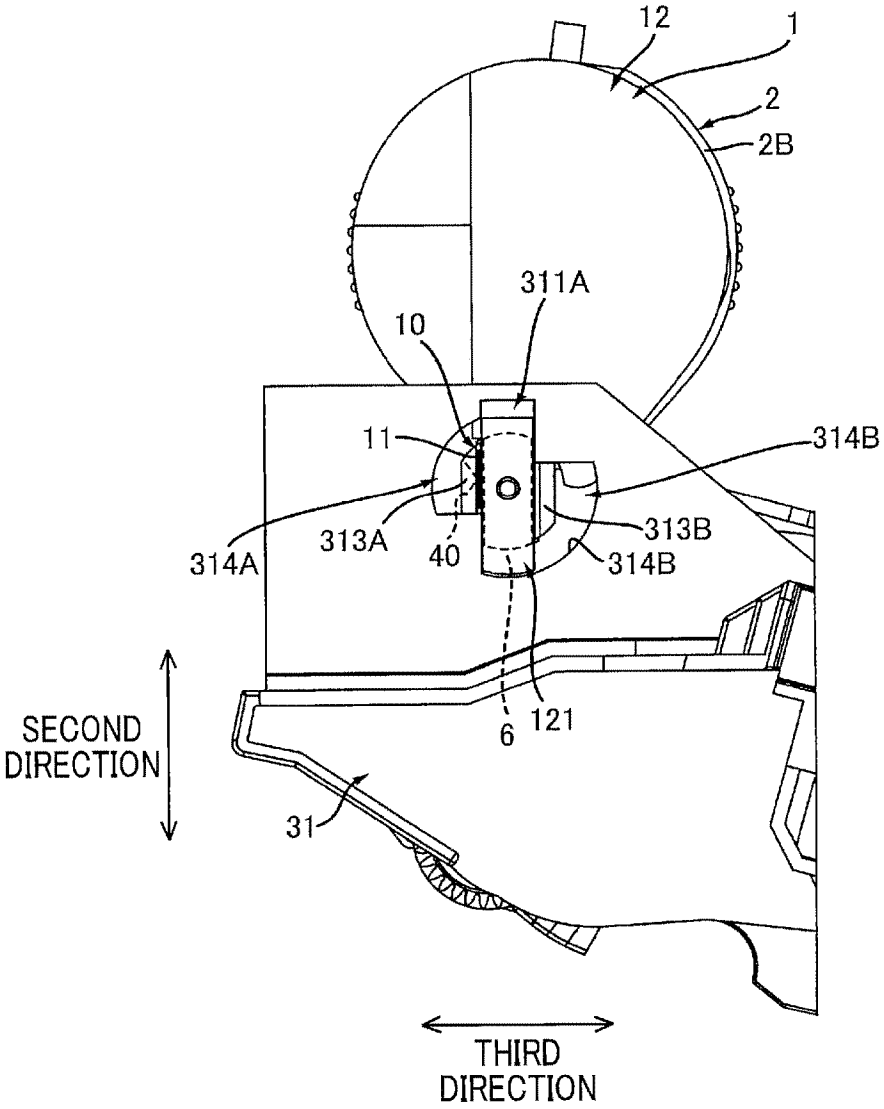
FIG. 8A is a side view of the toner cartridge and the developing device at one side thereof in a first direction, and particularly illustrating a state where the toner cartridge is mounted on the developing device and a casing is at its first position.

Then, as illustrated in FIGS. 8A and 8B, in accordance with the pivotal movement of the casing 2 from the first position (FIG. 8A) to the second position (FIG. 8B), the casing 2 pivots relative to the first protrusion 6 and the shutter 5 whose positions are fixed relative to the developing device 31. That is, in accordance with the pivotal movement of the casing 2 from the first position to the second position, the casing 2 pivots relative to the memory 10 and the plurality of electrical contact surfaces 11 whose positions are fixed relative to the developing device 31. The electrical contact surfaces 11 are in contact with the electrical connector 40 during the pivotal movement of the casing 2 from the first position to the second position. The electrical contact surfaces 11 are in contact with the electrical connector 40 in the case where the casing 2 is positioned at the first position (FIG. 8A) as well as in the case where the casing 2 is the second position (FIG. 8B). Accordingly, stabilized contact of the electrical contact surfaces 11 of the toner cartridge 1 with the electrical connector 40 of the developing device 31 can be achieved irrespective of the pivotal movement of the casing 2 between the first position and the second position.

Incidentally, the electrical connector 40 is electrically connected to a control circuit board provided in the image-forming apparatus through a non-illustrated wiring. Hence, the control circuit board can read the information about the toner cartridge 1 stored in the memory 10 in a state where the developing device 31 having the toner cartridge 1 attached thereto is attached to the image-forming apparatus.

3.1.1.2 Recessed Portions 314A and 314B

As illustrated in FIG. 7, the recessed portion 314A is positioned opposite to the protrusion 313B with respect to the protrusion 313A in the widthwise direction of the groove 311A. The recessed portion 314A is recessed away from the protrusion 313A in the widthwise direction of the groove 311A. The recessed portion 314A has an arcuate surface 315A. The arcuate surface 315A is positioned apart from the protrusion 313A. The arcuate surface 315A extends in a rotational direction of the cover portion 121 defined in accordance with the pivotal movement of the casing 2 relative to the developing device 31 from the first position to the second position. A part of the cover portion 121 passes through a portion between the protrusion 313A and the arcuate surface 315A when the casing 2 pivots relative to the developing device 31.

The recessed portion 314B is positioned opposite to the protrusion 313A with respect to the protrusion 313B in the widthwise direction of the groove 311A. The recessed portion 314B has an arcuate surface 315B. The description as to the recessed portion 314A is also applicable to the recessed portion 314B.

3.1.2 Groove 311B

As illustrated in FIG. 10, the groove 311B is positioned at another end portion of the developing casing 311 in the first direction. As illustrated in FIG. 9A, the second protrusion 9 is fitted in the groove 311B when the toner cartridge 1 is mounted to the developing device 31. The position of the second protrusion 9 relative to the developing device 31 is thus fixed when the toner cartridge 1 is mounted on the developing device 31.

Figure 9B:
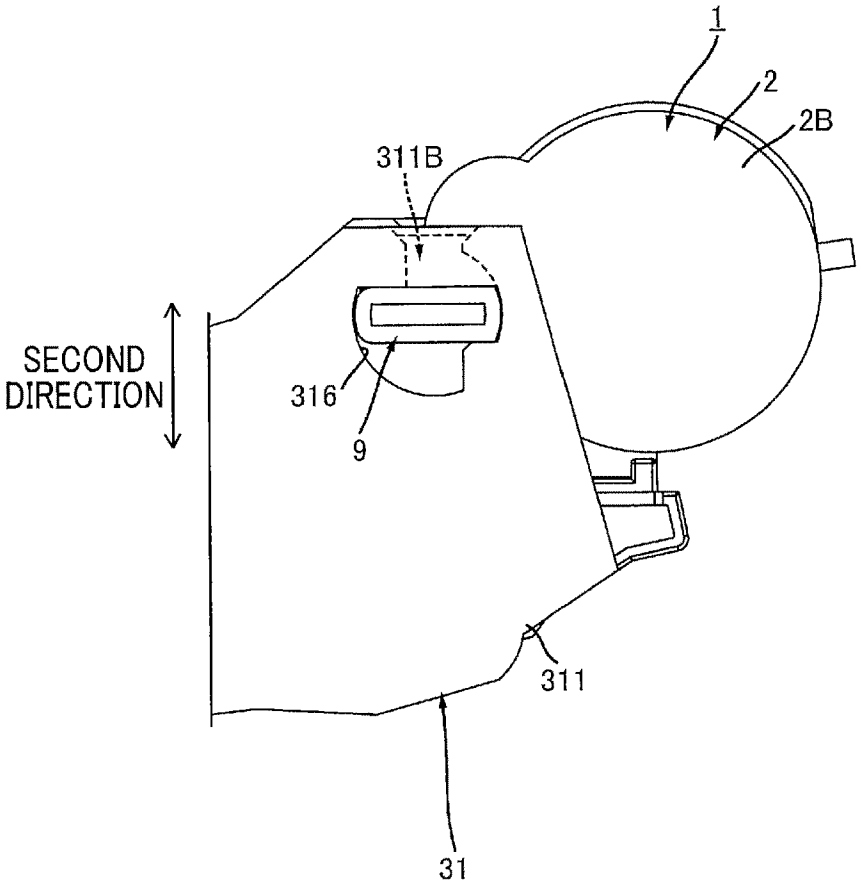
FIG. 9B is a side view illustrating the state where the casing illustrated in FIG. 9A is at the second position and the toner cartridge is attached to the developing device.
Figure 9A:
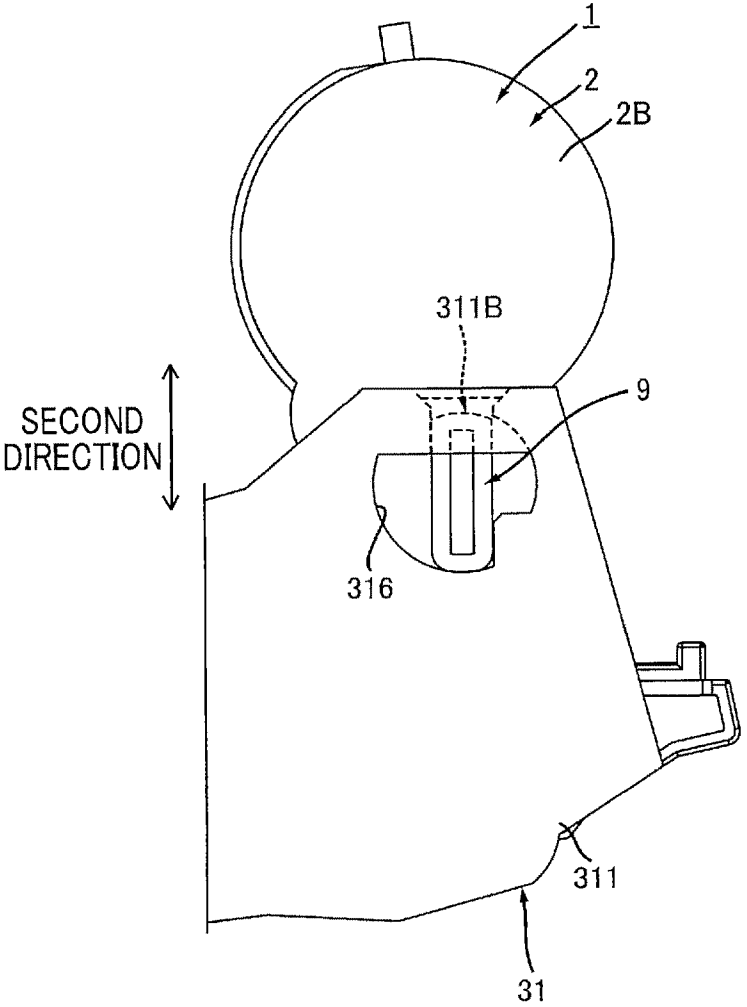
FIG. 9A is a side view of the toner cartridge and the developing device at another side in the first direction, and particularly illustrating the state where the toner cartridge is mounted on the developing device and the casing is at the first position.

As illustrated in FIGS. 9A and 9B, the second protrusion 9 is rotatable relative to the developing device 31 in a state where the second protrusion 9 is fitted in the groove 311B. The second protrusion 9 can rotate together with the casing 2 when the casing 2 pivots from the first position (FIG. 9A) to the second position (FIG. 9B) in the state where the toner cartridge 1 is mounted to the developing device 31.

Specifically, the groove 311B has a recessed portion 316. The recessed portion 316 allows the second protrusion 9 to rotate in a state where the second protrusion 9 is fitted in the groove 311B. The recessed portion 316 has an arcuate shape.

3.1.3 Developing Opening 311C

As illustrated in FIG. 10, the developing opening 311C is positioned between the groove 311A and the groove 311B in the first direction. The developing opening 311C is in communication with an interior of the developing casing 311.

Figure 12B:
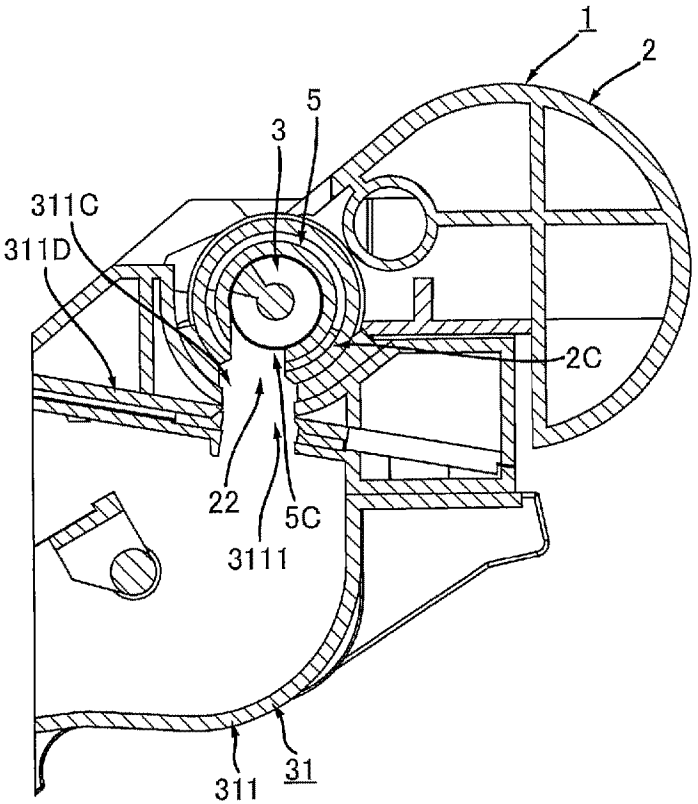
FIG. 12B is a cross-sectional view illustrating the state where the casing illustrated in FIG. 12A is at the second position and the toner cartridge is attached to the developing device.
Figure 12A:
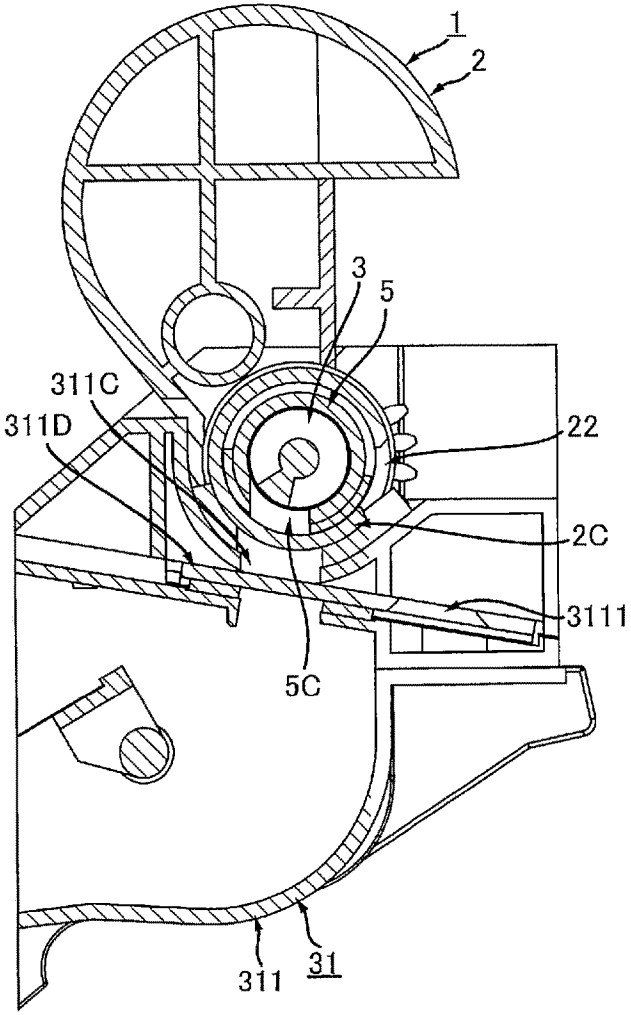
FIG. 12A is a cross-sectional view of the developing device and the toner cartridge taken along a plane passing through a shutter opening, and particularly illustrating the state where the toner cartridge is mounted on the developing device and the casing is at the first position.

As illustrated in FIG. 12A, the discharge opening 22 is positioned away from the developing opening 311C in the state where the toner cartridge 1 is mounted to the developing device 31. Hence, the developing opening 311C does not communicate with the discharge opening 22 and the shutter opening 5C in the state where the toner cartridge 1 is mounted to the developing device 31. In other words, the shutter 5 closes the discharge opening 22 in the case where the casing 2 is at the first position. The toner cartridge 1 cannot supply the toner to the developing device 31 in the state where the toner cartridge 1 is mounted to the developing device 31.

As illustrated in FIG. 12B, the developing opening 311C communicates with the discharge opening 22 and the shutter opening 5C of the toner cartridge 1 in a state where the toner cartridge 1 is attached to the developing device 31. In other words, in a case where the casing 2 is at the second position, at least a part of the shutter opening 5C is overlapped with at least a part of the discharge opening 22, and the shutter opening 5C allows the toner to be discharged therethrough through the discharge opening 22. The toner cartridge 1 can supply the toner to the developing device 31 in the state where the toner cartridge 1 is attached to the developing device 31.

3.1.4 Developing Shutter 311D

The developing shutter 311D is movable between a closed position (see FIG. 12A) where the developing shutter 311D closes the developing opening 311C and an open position (see FIG. 12B) where the developing shutter 311D opens the developing opening 311C. That is, the developing shutter 311D is configured to open and close the developing opening 311C provided in the developing device 31. The developing shutter 311D has an opening 3111. As illustrated in FIG. 10, the developing shutter 311D includes a gear portion 3112A and a gear portion 3112B.

The opening 3111 extends throughout a thickness of the developing shutter 311D in a mounting direction of the toner cartridge 1 on the developing device 31. As illustrated in FIG. 12B, the opening 3111 is overlapped with at least a part of the developing opening 311C when the developing shutter 311D is at the open position. Accordingly, the opening 3111 permits the toner in the toner cartridge 1 to be entered into the interior of the developing casing 311 through the developing opening 311C and the opening 3111 when the developing shutter 311D is at the open position.

Figure 13B:
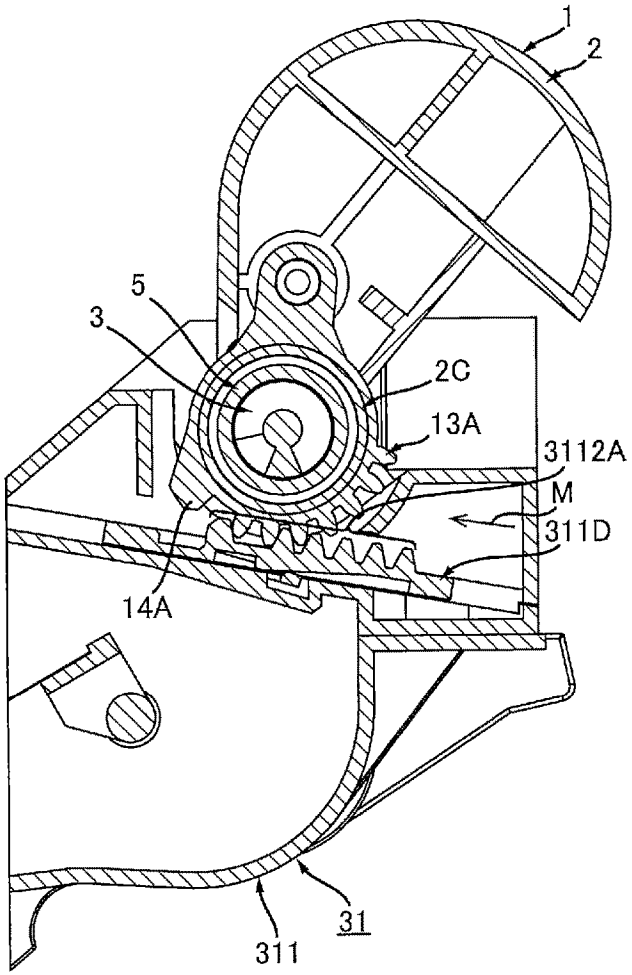
FIG. 13B is a cross-sectional view illustrating a state where the casing illustrated in FIG. 13A is pivotally moved from the first position toward the second position and a gear portion of the toner cartridge is in meshing engagement with the gear portion of the developing shutter.
Figure 13A:
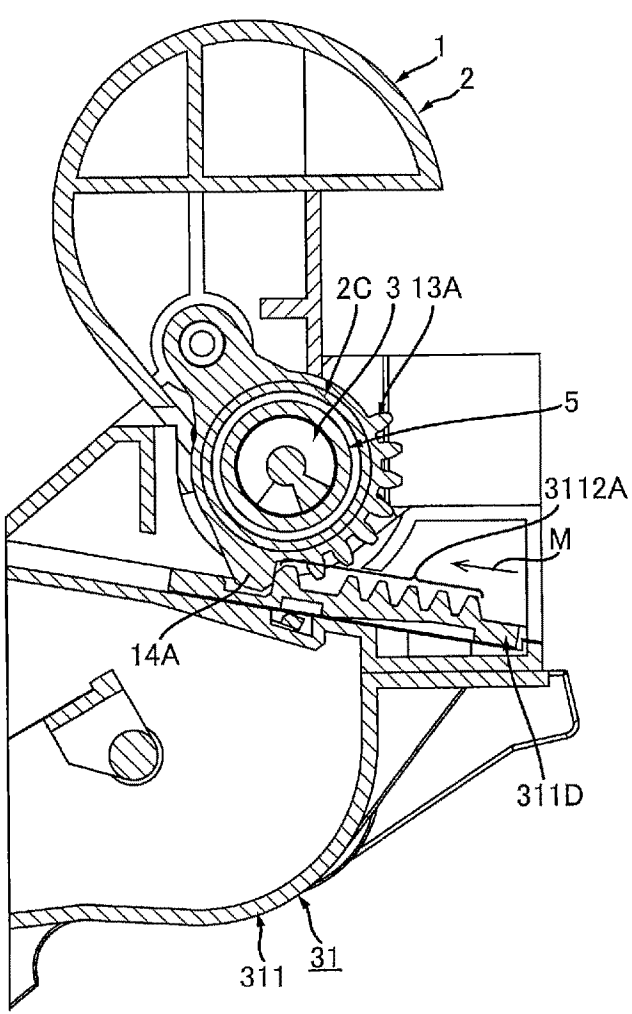
FIG. 13A is a cross-sectional view of the developing device and the toner cartridge taken along a plane passing through a gear portion of a developing shutter, and particularly illustrating the state where the toner cartridge is mounted on the developing device and the casing is at the first position.

As illustrated in FIGS. 13A and 13B, the gear portion 3112A is configured to meshingly engage the gear portion 13A of the toner cartridge 1 when the casing 2 pivots from the first position to the second position in the state where the toner cartridge 1 is mounted on the developing device 31. That is, at least one of the plurality of gear teeth of the gear portion 13A engages the developing shutter 311D in a case where the toner cartridge 1 is pivotable relative to the developing device 31.

The gear portion 3112A is a rack gear including a plurality of gear teeth arranged in line in a moving direction M of the developing shutter 311D. The developing shutter 311D is configured to move from the closed position to the open position in response to the pivotal movement of the casing 2 from the first position to the second position in a state where the gear portion 3112A is in meshing engagement with the gear portion 13A.

On the other hand, developing shutter 311D is configured to move from the open position to the closed position in response to the pivotal movement of the casing 2 from the second position to the first position in the state where the gear portion 3112A is in meshing engagement with the gear portion 13A.

The gear portion 3112A is positioned away from the gear portion 3112B in the first direction. The gear portion 3112A is positioned opposite to the gear portion 3112B with respect to the developing opening 311C in the first direction. The gear portion 3112B is configured to meshingly engage the gear portion 13B of the toner cartridge 1 when the casing 2 pivots from the first position to the second position in the state where the toner cartridge 1 is mounted on the developing device 31. The gear portion 3112B is a rack gear including a plurality of gear teeth arranged in line in the moving direction M of the developing shutter 311D.

3.2 Developing Roller 312

As illustrated in FIG. 10, the developing roller 312 is positioned at one end portion of the developing casing 311 in a direction crossing the first direction. The developing roller 312 is supported by the developing casing 311. The developing roller 312 extends in the first direction. The developing roller 312 is rotatable about a developing axis A4 extending in the first direction.

5. Technical Advantages and Effects (1) According to the toner cartridge 1 described above, positioning of the first protrusion 6 relative to the developing device 31 is performed in the state where the toner cartridge 1 is mounted to the developing device 31, as illustrated in FIGS. 8A and 11.

Therefore, contact of the electrical contact surfaces 11 of the toner cartridge 1 with the electrical connector 40 of the gear portion 13A can be realized by making use of the positioning of the first protrusion 6 of the toner cartridge 1 relative to the developing device 31.

As a result, stabilized contact between the electrical contact surfaces 11 of the toner cartridge 1 and the electrical connector 40 of the developing device 31 can be obtained.

(2) According to the toner cartridge 1, the position of the toner cartridge 1 can be fixed with respect to the developing device 31 by the first protrusion 6 and the second protrusion 9 when the toner cartridge 1 is attached to the developing device 31, as illustrated in FIGS. 8A and 9A.

Therefore, the contact of the electrical contact surfaces 11 with the electrical connector 40 of the developing device 31 can be attained by making use of the positioning of the first protrusion 6 of the toner cartridge 1 relative to the developing device 31.

As a result, stabilized contact between the electrical contact surfaces 11 of the toner cartridge 1 and the electrical connector 40 of the developing device 31 can be obtained.

(3) According to the toner cartridge 1, the electrical contact surfaces 11 are configured to contact the electrical connector 40 in the case where the casing 2 is at the first position as well as in the case where the casing 2 is at the second position, as illustrated in FIGS. 8A and 8B.

Therefore, stabilized contact between the electrical contact surfaces 11 of the toner cartridge 1 and the electrical connector 40 of the developing device 31 can be achieved irrespective of the pivotal movement of the casing 2 between the first position and the second position.

6. Modifications

The toner conveying unit of the disclosure need not be in a form of the depicted auger 3. For example, the toner conveying unit may be an auger including a shaft and a fin extending from the shaft.

While the description has been made in detail with reference to the embodiments, it would be apparent to those skilled in the art that many modifications and variations may be made thereto.

REMARKS

The toner cartridge 1 is an example of a toner cartridge of the disclosure. The casing 2 is an example of a casing. The first cover 2C is an example of a first cover. A combination of the casing 2 and the first cover 2C is another example of a casing of the toner cartridge. The first toner accommodating portion 2A is an example of a first toner accommodating portion. The second toner accommodating portion 2B is an example of a second toner accommodating portion. The discharge opening 22 is an example of a discharge opening. The auger 3 is an example of a toner conveying unit, and an example of an auger. The shutter 5 is an example of a shutter. The memory 10 is an example of a memory. The electrical contact surfaces 11 are an example of an electrical contact surface. The first protrusion 6 is an example of a first protrusion. The second protrusion 9 is an example of a second protrusion. The second cover 12 is an example of a second cover. The locking member 122 is an example of a locking member. The stopper 124 is an example of a stopper. The developing device 31 is an example of a developing device. The developing shutter 311D is an example of a developing shutter. The developing opening 311C is an example of a developing opening.

What is claimed is:

1. A toner cartridge comprising:

a casing extending in a first direction and including a first toner accommodating portion defining a first internal space therein configured to store toner, the first toner accommodating portion having one end portion in the first direction, the one end portion of the first toner accommodating portion having an accommodating portion opening configured to allow the toner in the first internal space to be discharged therefrom;

a toner conveying unit extending in the first direction and rotatable about a first axis extending in the first direction, the toner conveying unit being configured to convey the toner from the first internal space to the accommodating portion opening;

a first cover positioned at the one end portion of the first toner accommodating portion and covering the accommodating portion opening, the first cover being movable together with the casing and having a discharge opening configured to allow the toner to be discharged therethrough;

a shutter positioned at the one end portion of the first toner accommodating portion and having a shutter opening, the shutter having a first protrusion extending in the first direction and positioned farther from the one end portion of the first toner accommodating portion than the first cover is from the one end portion of the first toner accommodating portion in the first direction;

a memory configured to store information about the toner cartridge; and an electrical contact surface electrically connected to the memory and positioned at the first protrusion, wherein, when the toner cartridge is mounted to a developing device, a position of the first protrusion is fixed relative to the developing device and the casing is pivotally movable together with the first cover between a first position and a second position relative to the developing device, wherein the shutter closes the discharge opening in a case where the casing is at the first position, and wherein at least a part of the shutter opening is overlapped with at least a part of the discharge opening to allow the toner to be discharged through the discharge opening and through the shutter opening in a case where the casing is at the second position.

2. The toner cartridge according to claim 1, wherein the electrical contact surface is positioned at an outer surface of the first protrusion.

3. The toner cartridge according to claim 1, wherein the information about the toner cartridge includes at least one of: information as to whether the toner cartridge is a new cartridge or a used cartridge; and information as to the number of sheets on which printing can be performed with the toner cartridge.

4. The toner cartridge according to claim 1, wherein the memory has the electrical contact surface.

5. The toner cartridge according to claim 1, further comprising a second cover covering at least a part of a tip end portion of the first protrusion and rotatably supporting the tip end portion of the first protrusion, the second cover having an opening through which at least a part of the first protrusion is exposed, wherein the casing is pivotally movable together with the first cover and the second cover relative to the developing device between the first position and the second position when the toner cartridge is mounted to the developing device.

6. The toner cartridge according to claim 5,
wherein the part of the first protrusion exposed through the opening of the second cover is fixed in position relative to the developing device when the toner cartridge is mounted to the developing device.

7. The toner cartridge according to claim 5,
wherein the second cover includes a locking member configured to lock the first protrusion to the second cover, and
wherein the locking member is configured to unlock the first protrusion when the toner cartridge is mounted to the developing device.

8. The toner cartridge according to claim 7,
wherein the locking member is movable between a locking position where the locking member locks the first protrusion to the second cover and an unlocking position where the locking member unlocks the first protrusion from the second cover, and
wherein the locking member is configured to contact a part of the developing device to move from the locking position to the unlocking position in a case where the toner cartridge is mounted on the developing device.

9. The toner cartridge according to claim 5,
wherein the second cover has a stopper configured to restrict the first protrusion from rotating in a reverse rotational direction opposite to a rotational direction of the casing from the first position to the second position relative to the shutter.

10. The toner cartridge according to claim 9,
wherein the first protrusion is configured to contact the stopper in a case where the first protrusion is urged to rotate in the reverse rotational direction in the case where the casing is at the first position.

11. The toner cartridge according to claim 1,
wherein the toner conveying unit has a helical shape.

12. The toner cartridge according to claim 11,
wherein the toner conveying unit is an agitator rotatable about the first axis.

13. The toner cartridge according to claim 1,
wherein the toner conveying unit has a part positioned in the first internal space, and
wherein the first cover covers one end portion of the toner conveying unit in the first direction.

14. The toner cartridge according to claim 13,
wherein the toner conveying unit extends to the discharge opening, and
wherein the first cover extends along a peripheral surface of the one end portion of the toner conveying unit to cover the peripheral surface of the one end portion of the toner conveying unit.

15. The toner cartridge according to claim 14,
wherein the shutter extends along the peripheral surface of the one end portion of the toner conveying unit to cover the peripheral surface, and
wherein the first cover extends along a peripheral surface of the shutter to cover the peripheral surface of the shutter.

16. The toner cartridge according to claim 14,
wherein the shutter extends along an inner peripheral surface of the first cover.

17. The toner cartridge according to claim 1,
wherein the toner conveying unit extends to the discharge opening, and
wherein the shutter extends along a peripheral surface of one end portion of the toner conveying unit in the first direction to cover the peripheral surface of the one end portion of the toner conveying unit.

18. The toner cartridge according to claim 1,
wherein the casing further includes a second toner accommodating portion positioned at one side of the first toner accommodating portion in a second direction, the second toner accommodating portion defining therein a second internal space in communication with the first internal space and having a length in the first direction shorter than a length in the first direction of the first internal space,
the toner cartridge further comprising an agitator rotatable about a second axis extending in the first direction and configured to agitate the toner in the second internal space to convey the toner from the second internal space to the first internal space.

19. The toner cartridge according to claim 18,
wherein the agitator is positioned in the second internal space.

20. The toner cartridge according to claim 18,
wherein the discharge opening is positioned away from the first toner accommodating portion in the first direction.

21. The toner cartridge according to claim 18,
wherein the first internal space and the second internal space are juxtaposed with each other in the second direction, the second direction being defined by connecting the first axis to the second axis.

22. The toner cartridge according to claim 1,
wherein the first cover includes a plurality of gear teeth positioned on a peripheral surface of the first cover, the plurality of gear teeth being arranged in line in a rotational direction of the first cover.

23. The toner cartridge according to claim 22,
wherein at least one of the plurality of gear teeth is engaged with a developing shutter of the developing device in a case where the toner cartridge is pivotally movable relative to the developing device, the developing shutter being configured to open and close a developing opening of the developing device.

24. The toner cartridge according to claim 22,
wherein the first cover further includes a protrusion arranged in line with the plurality of gear teeth in the rotational direction of the first cover, the protrusion being positioned upstream of the plurality of gear teeth in the rotational direction of the first cover in a case where the casing pivots from the second position to the first position.

25. The toner cartridge according to claim 24,
wherein the protrusion is arranged in line with the plurality of gear teeth at an interval greater than an interval between neighboring gear teeth in the rotational direction of the first cover.

26. A toner cartridge comprising:
a casing extending in a first direction and comprising:
a first toner accommodating portion defining therein a first internal space extending in the first direction; and
a second toner accommodating portion defining therein a second internal space extending in the first direction and in communication with the first internal space, the second toner accommodating portion being positioned at one side of the first toner accommodating portion in a second direction, the casing having a discharge opening positioned at one side of the first toner accommodating portion in the first direction, the discharge opening being configured to allow the toner in the first toner accommodating portion to be discharged therefrom;

an auger rotatable about a first axis extending in the first direction and configured to convey the toner from the first internal space to the discharge opening;

an agitator rotatable about a second axis extending in the first direction and configured to agitate the toner in the second internal space to convey the toner from the second internal space to the first internal space;

a first protrusion positioned at one side of the first toner accommodating portion in the first direction and at one side of the discharge opening in the first direction, the first protrusion extending in the first direction;

a second protrusion positioned at another side of the first toner accommodating portion in the first direction, the second protrusion extending in the first direction;

a memory configured to store information about the toner cartridge; and an electrical contact surface electrically connected to the memory and positioned at the first protrusion.

27. The toner cartridge according to claim 26, wherein the electrical contact surface is positioned at an outer surface of the first protrusion.

28. The toner cartridge according to claim 26, wherein the information about the toner cartridge includes at least one of: information as to whether the toner cartridge is a new cartridge or a used cartridge; and information as to the number of sheets on which printing can be performed with the toner cartridge.

29. The toner cartridge according to claim 26, wherein the memory has the electrical contact surface.

30. The toner cartridge according to claim 26, wherein the first protrusion also extends in a second direction defined by connecting the first axis to the second axis, and wherein the second protrusion also extends in the second direction.

31. The toner cartridge according to claim 26, wherein the second protrusion has a width in a third direction crossing the first direction and the second direction, the width in the third direction of the second protrusion being different from a width in the third direction of the first protrusion.

32. The toner cartridge according to claim 26, wherein the auger has one end portion and another end portion apart from the one end portion in the first direction, a part of a peripheral surface of the one end portion of the auger being exposed to an outside through the discharge opening.

33. The toner cartridge according to claim 26, further comprising a shutter positioned at one end portion of the first toner accommodating portion in the first direction, the shutter being movable relative to the casing between a closed position where the shutter closes the discharge opening and an open position where the shutter opens the discharge opening, the shutter having the first protrusion.

34. The toner cartridge according to claim 33, wherein the first protrusion extends in the first direction from the shutter.

35. The toner cartridge according to claim 33, wherein the shutter is rotatable between the closed position and the open position about a third axis extending in the first direction.

36. The toner cartridge according to claim 35, wherein the first protrusion is rotatable together with the shutter.

37. The toner cartridge according to claim 35, wherein the shutter has a shutter opening, and wherein at least a part of the shutter opening is overlapped with at least a part of the discharge opening in a case where the shutter is at the open position.

38. The toner cartridge according to claim 35, wherein the auger has one end portion and another end portion apart from the one end portion in the first direction, a part of a peripheral surface of the one end portion of the auger being exposed to an outside through the discharge opening, and wherein the one end portion of the auger is exposed to the outside through the discharge opening in a case where the shutter is at the open position.

39. The toner cartridge according to claim 26, wherein the first toner accommodating portion has one end portion in the first direction, the one end portion of the first toner accommodating portion having an accommodating portion opening, and wherein the casing further comprises a first cover covering the one end portion of the first toner accommodating portion, the first cover also covering the accommodating portion opening.

40. The toner cartridge according to claim 39, wherein the auger has one end portion and another end portion apart from the one end portion in the first direction, the one end portion of the auger being exposed to an outside of the first toner accommodating portion through the accommodating portion opening, and wherein the first cover covers at least a part of the one end portion of the auger.

41. The toner cartridge according to claim 39, wherein the first cover has a plurality of gear teeth positioned on a peripheral surface of the first cover, the plurality of gear teeth being arranged in line in a rotational direction of the auger.

42. The toner cartridge according to claim 26, wherein the auger has one end portion and another end portion apart from the one end portion in the first direction, the toner cartridge further comprising an auger gear attached to the another end portion of the auger and rotatable together with the auger, and wherein the second protrusion is positioned farther away from the discharge opening than the auger gear is from the discharge opening in the first direction.

43. The toner cartridge according to claim 42, further comprising a gear cover covering at least a part of the auger gear, wherein the second protrusion extends in the first direction from the gear cover.

44. The toner cartridge according to claim 42, wherein the first toner accommodating portion has one end portion and another end portion away from the one end portion in the first direction, the first toner accommodating portion having a first through-hole at the another end portion of the first toner accommodating portion in the first direction, the first through-hole penetrating through the another end portion of the first toner accommodating portion in the first direction, wherein the another end portion of the auger is inserted in the first through-hole, and wherein the auger gear is positioned at an outer surface of the first toner accommodating portion.

45. The toner cartridge according to claim 26, wherein the discharge opening is positioned outward of the second toner accommodating portion toward the one side in the first direction.

46. The toner cartridge according to claim 26, wherein the agitator comprises:

an agitator shaft extending along the second axis; and a fin rotatable together with the agitator shaft and positioned in the second internal space, and wherein the discharge opening is positioned outward of the fin toward one side in the first direction.

47. The toner cartridge according to claim 26, wherein the first protrusion and the second protrusion are fixed in position relative to a developing device when the toner cartridge is mounted on the developing device, wherein the toner cartridge is attached to the developing device by pivotally moving the casing relative to the developing device about the first protrusion and the second protrusion after the toner cartridge is mounted on the developing device, wherein the developing device includes an electrical connector, and wherein the electrical contact surface is configured to contact the electrical connector in a case where the casing is at the first position as well as in a case where the casing is at the second position.

* * * * *